US008437668B2

(12) United States Patent
Okamoto et al.

(10) Patent No.: US 8,437,668 B2
(45) Date of Patent: May 7, 2013

(54) IMAGE FORMING AGENT STORAGE CONTAINER, IMAGE FORMING APPARATUS, METHOD OF MOUNTING/DETACHING IMAGE FORMING AGENT STORAGE CONTAINER AND METHOD OF FILLING/REFILLING IMAGE FORMING AGENT

(75) Inventors: Masaya Okamoto, Saitama (JP); Kota Furuhata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 12/817,838

(22) Filed: Jun. 17, 2010

(65) Prior Publication Data

US 2011/0020014 A1 Jan. 27, 2011

(30) Foreign Application Priority Data

Jul. 22, 2009 (JP) ..... 2009-171018

(51) Int. Cl.
*G03G 15/08* (2006.01)

(52) U.S. Cl.
USPC ..... 399/262; 222/DIG. 1

(58) Field of Classification Search ..... 399/12, 399/106, 258, 262, 263, 109; 222/469, DIG. 1; 347/86
See application file for complete search history.

(56) References Cited

U.S. PATENT DOCUMENTS 7,062,205 B2 * 6/2006 Nagashiro ..... 399/258
7,369,798 B2 * 5/2008 Sasae et al. ..... 399/262
7,738,817 B2 * 6/2010 Sasae et al. ..... 399/258
D661,344 S * 6/2012 Okamoto et al. ..... D18/43
2005/0008400 A1 * 1/2005 Tazawa et al. ..... 399/263

FOREIGN PATENT DOCUMENTS

JP A-2006-139013 6/2006
JP A-2006-139065 6/2006
JP 2007041104 A * 2/2007
JP A-2007-093697 4/2007

OTHER PUBLICATIONS

Japanese Office Action issued in Japanese Patent Application No. 2009-171018 on Sep. 4, 2009 (with English-language translation).

* cited by examiner

*Primary Examiner* — Robert Beatty
(74) *Attorney, Agent, or Firm* — Oliff & Berridge, PLC

(57) ABSTRACT

A storage container includes a container body formed with a discharge hole and a filling hole, an opening and closing part opening and closing the discharge hole, a lid member sealing the filling hole, and an operating member having a facing portion facing the filling hole and used to operate the opening and closing part. The operating member moves between a first position where the discharge hole is brought into an opened state, a second position where the discharge hole is brought into a closed state, and where the facing portion is arranged at a position which overlaps the container body, and a third position where the discharge hole is brought into a closed state, and where the facing portion is arranged at a position which does not overlap the container body in the direction of gravity in which the sealing part is attached to the container body.

13 Claims, 20 Drawing Sheets

IMAGE FORMING AGENT STORAGE CONTAINER, IMAGE FORMING APPARATUS, METHOD OF MOUNTING/DETACHING IMAGE FORMING AGENT STORAGE CONTAINER AND METHOD OF FILLING/REFILLING IMAGE FORMING AGENT

CROSS-REFERENCE TO RELATED APPLICATIONS

This application is based on and claims priority under 35 USC 119 from Japanese Patent Application No. 2009-171018 filed on Jul. 22, 2009.

BACKGROUND

Technical Field

The present invention relates to an image forming agent storage container, an image forming apparatus, a method of mounting the image forming agent storage container, a method of detaching the image forming agent storage container, a method of filling an image forming agent and method of refilling the image forming agent.

SUMMARY

According to an aspect of the invention, an image forming agent storage container includes a container body, a sealing part, an opening and closing part, and an operating part. The container body is attached to and detached from an inside of an image forming apparatus body, and is formed with a discharge hole used for discharging an image forming agent and a filling hole used for filling the image forming agent. The discharge hole is formed on one side of the container body in a direction in which the container body is attached to and detached from the inside of the image forming apparatus body, and the filling hole is formed on the other side of the container body in the direction in which the container body is attached to and detached from the inside of the image forming apparatus body. The sealing part is attached to the container body to seal the filling hole in the direction in which the container body is attached to and detached from the inside of the image forming apparatus body. The opening and closing part opens and closes the discharge hole while moving relative to the container body. The operating part (i) has a facing portion facing the filling hole, (ii) is connected to the opening closing part, (iii) is supported to rotate relative to the container body, and (iv) is used to move the opening and closing part relative to the container body. The operating part moves between a first position where the discharge hole is brought into an opened state, and where the facing portion is arranged at a position which overlaps the container body in a direction in which the sealing part is attached to the container body, a second position where the discharge hole is brought into a closed state, and where the facing portion is arranged at a position which overlaps the container body in the direction in which the sealing part is attached to the container body, and a third position where the discharge hole is brought into the closed state, and where the facing portion is arranged at a position which does not overlap the container body in the direction in which the sealing part is attached to the container body.

BRIEF DESCRIPTION OF THE DRAWINGS

Exemplary embodiment(s) of the present invention will be described in detail based on the following figures, wherein:

FIG. 7A is a side view showing a state where the operating member is at a first position, FIG. 7B is a side view showing a state where the operating member is at a second position, and FIG. 7C is a side view showing a state where the operating member is in a third position.

FIG. 8A is a sectional view showing a state where the operating member is in the first position, FIG. 8B is a sectional view showing a state where the operating member is in the second position, and FIG. 8C is a sectional view showing a state where the operating member is in the third position.

FIG. 15A is a right side view showing the storage container in a state where the operating member has been arranged in the second position, and FIG. 15B is a view showing the right side face of the storage container, and a cross-section of the mounting device.

DETAILED DESCRIPTION

Hereinafter, exemplary embodiments of the invention will be described with reference to the accompanying drawings.

Figure 1:
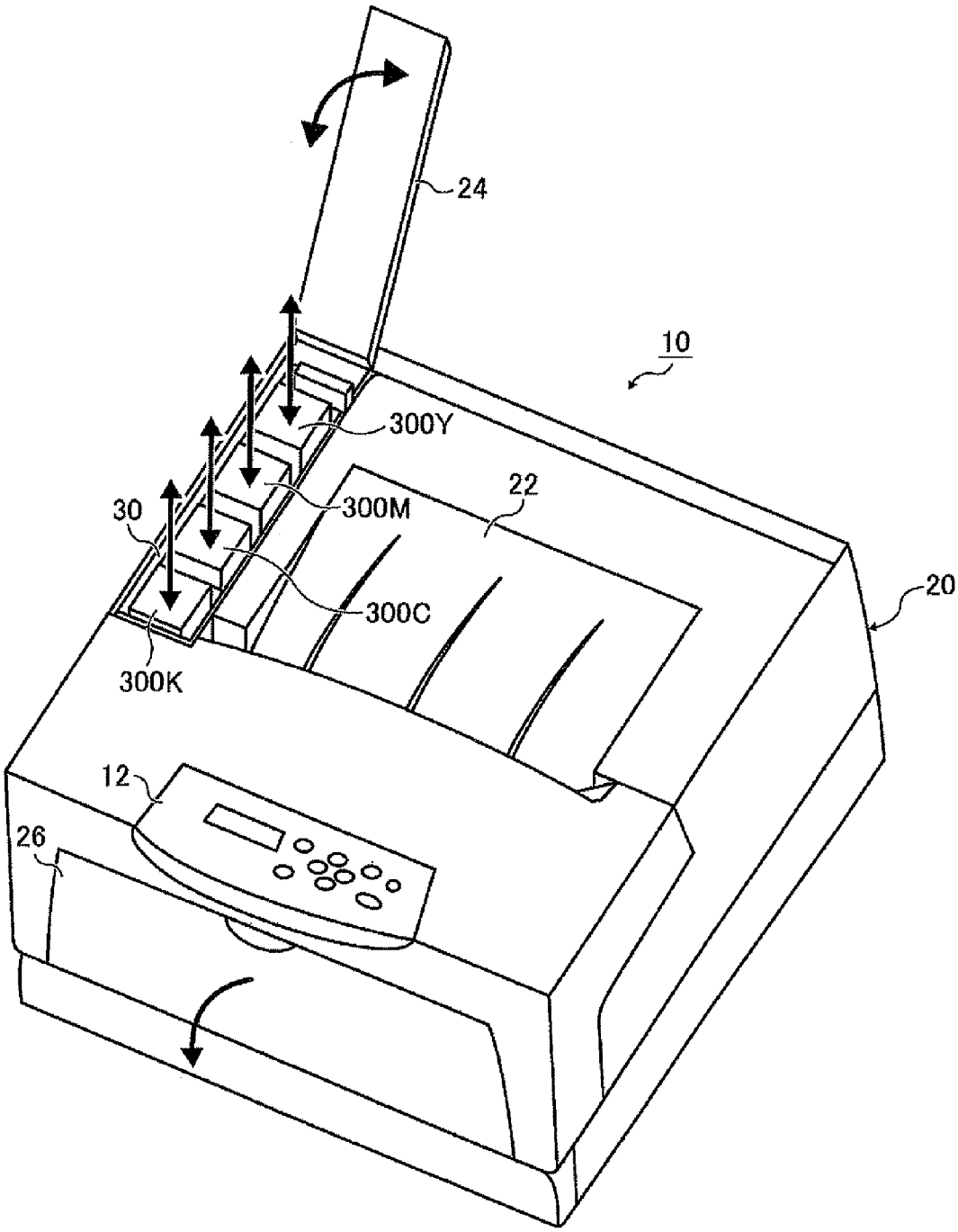
FIG. 1 is a perspective view showing an image forming apparatus according to an exemplary embodiment of the invention.

FIG. 1 shows an image forming apparatus 10 according to the exemplary embodiment of the invention. As shown in FIG. 1, the image forming apparatus 10 has an image forming apparatus body 20, and an upper part of the image forming apparatus body 20 is used as a discharge part 22 from which a paper on which an image has been formed is discharged. Also, an operation panel 12 used as an operation device is mounted to a front side of the image forming apparatus body 20.

A mounting opening and closing part 24, and a paper-feed opening and closing part 26 are mounted to the image forming apparatus body 20 so that each of them can be opened and closed. The mounting opening and closing part 24 is opened when storage containers 300Y, 300M, 300C, and 300K used image forming agent storage containers are mounted to the image forming apparatus body 20, and is opened when the storage containers 300Y, 300M, 300C, and 300K are detached from an inside of the image forming apparatus body 20. The mounting opening and closing part 24 is closed when image formation is performed. The paper-feed opening and closing part 26 is opened when papers on which images are to be formed are supplied from the front side of the image forming apparatus body 20. Also, the mounting opening and closing part 24 is opened and closed in a manner of rotating the mounting opening and closing 24 with the rear of the image forming apparatus body 20 in FIG. 1 used as a fulcrum (in such a manner that a fulcrum is formed on a short side of the mounting opening and closing part 24). However, this is not limited to the configuration of FIG. 1. The mounting opening and closing part 24 may be opened and closed in a manner of rotating the mounting opening and closing part 24 with a side of the image forming apparatus body 20 used as a fulcrum (in such a manner that a fulcrum is formed on a long side of the mounting opening and closing part 24).

Also, a mounting device 30 on which the storage containers 300Y, 300M, 300C, and 300K are to be mounted is provided in the image forming apparatus body 20.

Yellow toner, magenta toner, cyan toner, and black toner used as image forming agents are respectively stored in the storage containers 300Y, 300M, 300C, and 300K. The storage containers 300Y, 300M, and 300C have the same shape and size, and are configured to be able to store the same capacity of toner. The storage container 300K is configured so as to be vertically longer than the storage containers 300Y, 300M, and 300C, and has a larger volume than the storage containers 300Y, 300M, and 300C, with a larger capacity that stores more toner than the storage containers 300Y, 300M, and 300C.

The storage containers 300Y, 300M, and 300C have different toner capacity from the storage container 300K, but have the same members and functions. Hereinafter, except for the case where a specific storage container is shown, the storage containers 300Y, 300M, 300C and 300K will be collectively referred to as the storage container 300.

Figure 2:
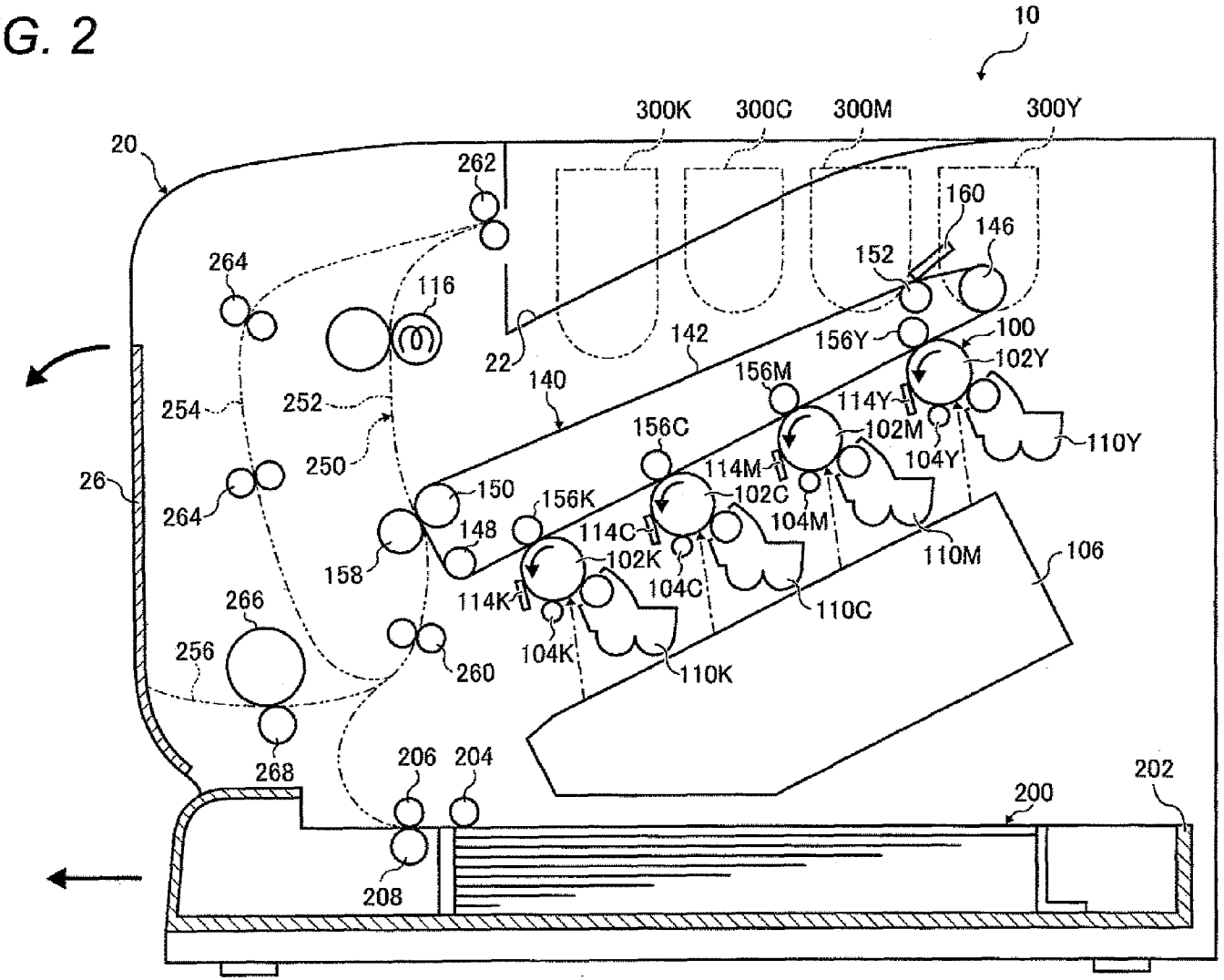
FIG. 2 is a sectional view showing the image forming apparatus according to the exemplary embodiment of the invention from a side.
Figure 3:
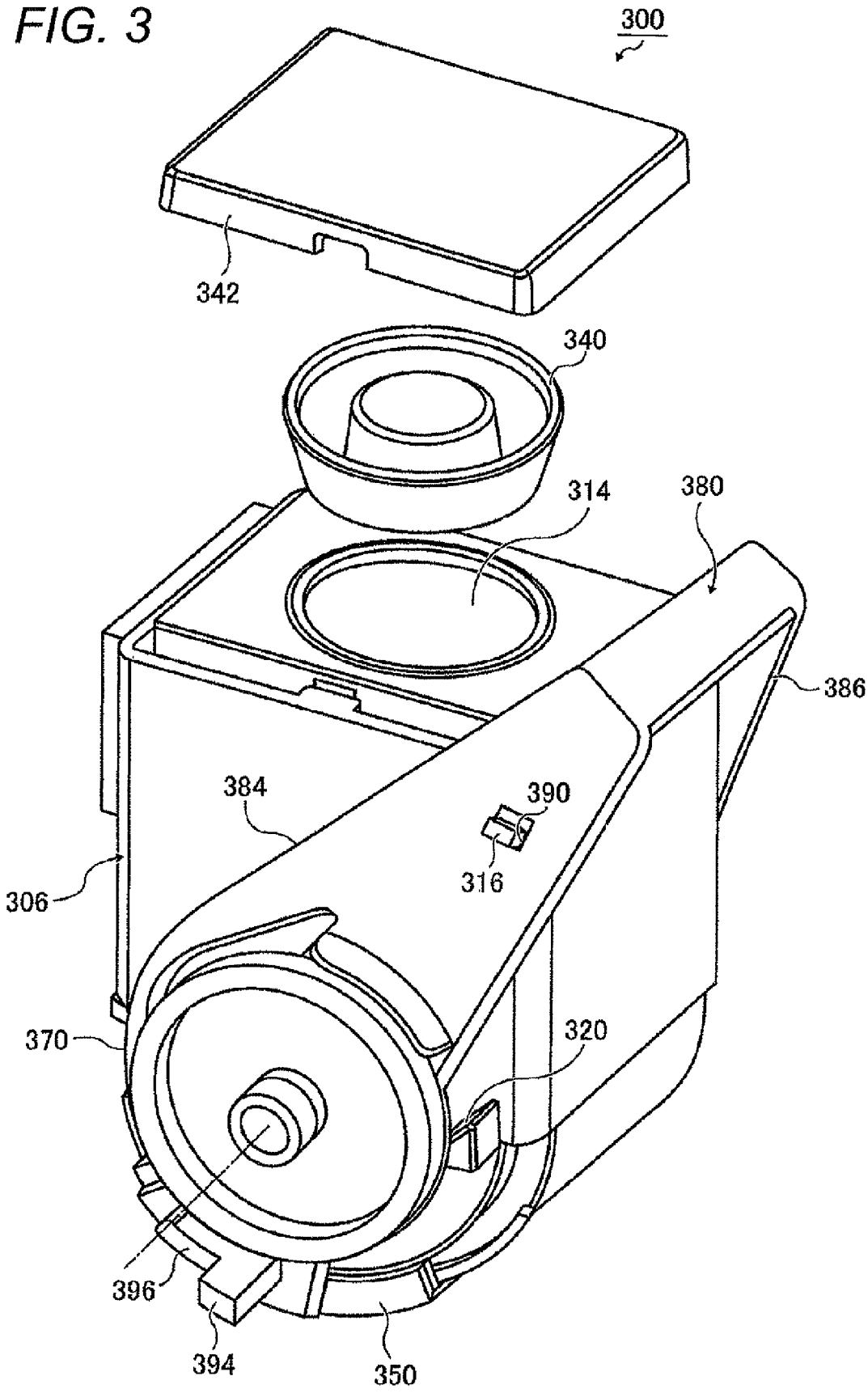
FIG. 3 is a first perspective view showing a storage container according to the exemplary embodiment of the invention which is partially disassembled.
Figure 4:
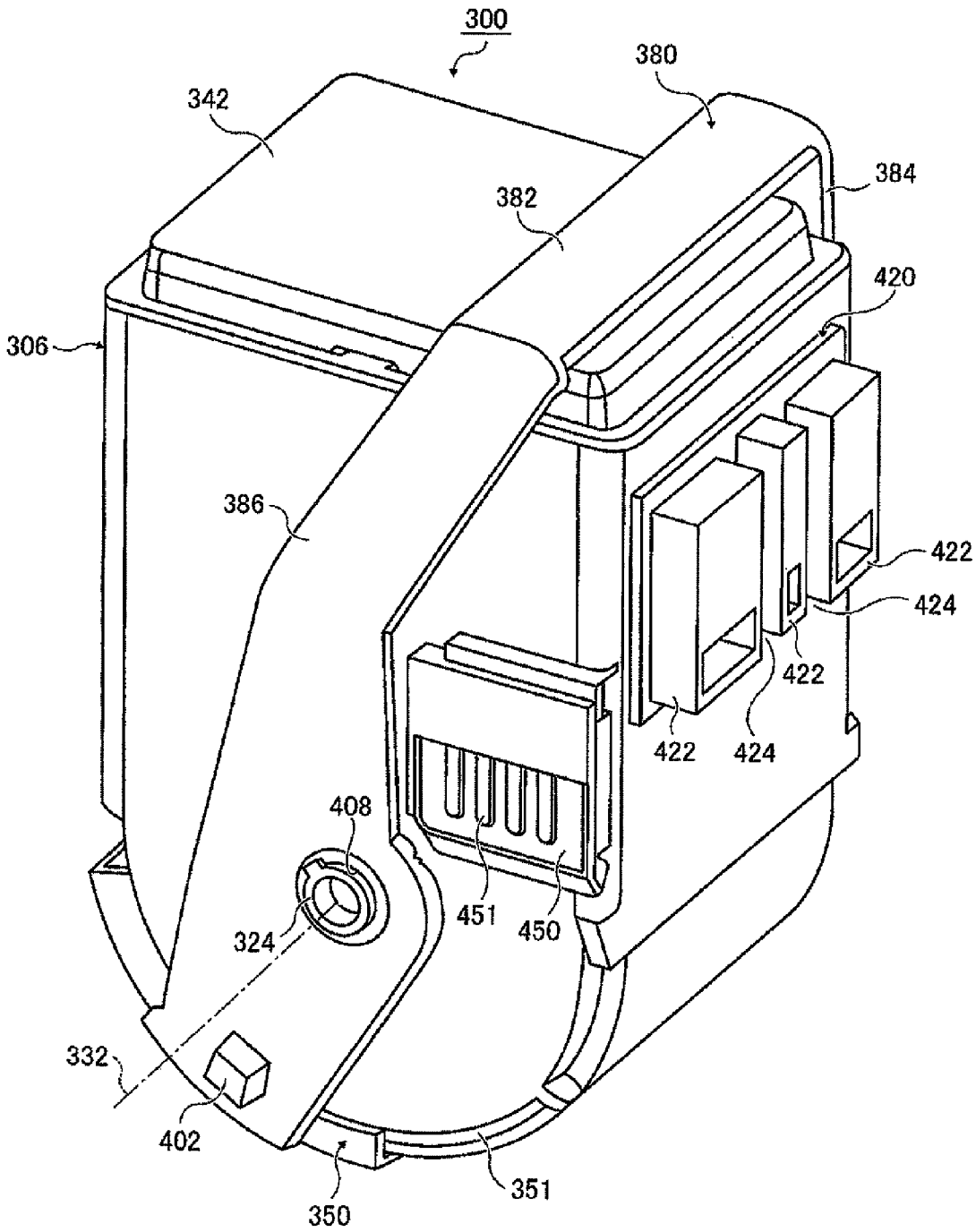
FIG. 4 is a second perspective view showing the storage container according to the exemplary embodiment of the invention.

FIG. 2 is a section of the image forming apparatus 10.

As shown in FIG. 2, an image forming part 100 and a paper feeder 200 which supplies papers to the image forming part 100 are mounted to the image forming apparatus body 20. Also, a conveyance path 250 used for conveyance of papers is formed in the image forming apparatus body 20.

The image forming part 100 has photosensitive drums 102Y, 102M, 102C, and 102K used as image carriers, charging devices 104Y, 104M, 104C, and 104K which respectively charge the photosensitive drums 102Y, 102M, 1020, and 102K, a latent image forming device 106 which emit light onto the photosensitive drums 102Y, 102M, 102C, and 102K charged by the charging devices 104Y, 104M, 104C, and 104K to form electrostatic latent images, and developing devices 110Y, 110M, 110C, and 110K which develop electrostatic latent images, which have been formed on the surfaces of the photosensitive drums 102Y, 102M, 102C, and 102K by the latent image forming device 106, using toner to form a yellow toner image, a magenta toner image, a cyan toner image, and a black toner image.

Yellow toner, magenta toner, cyan toner, and black toner are supplied to the developing devices 110Y, 110M, 110C, and 110K, respectively from the storage containers 300Y, 300M, 300C, and 300K.

Also, the image forming part 100 has a transfer device 140 which transfers to a paper the yellow toner image, the magenta toner image, the cyan toner image, and the black toner image, which have respectively been formed by the developing devices 110Y, 110M, 110C, and 110K. The image forming part 100 also has cleaning devices 114Y, 114M, 114C, and 114K which clean the surfaces of the photosensitive drums 102Y, 102M, 102C, and 102K, and a fixing device 116 which fixes the toner images transferred by the transfer device 140 to the paper.

The transfer device 140 has a belt-like intermediate transfer body 142 to which the yellow toner image, the magenta toner image, the cyan toner image, and the black toner image, which have been formed on the photosensitive drums 102Y, 102M, 102C, and 102K, are transferred so as to overlap each other, and which is used as a transfer medium. The intermediate transfer body 142 is supported by supporting rollers 146, 148, 150, and 152 so as to be rotatable.

Also, the transfer device 140 has primary transfer rollers 156Y, 156M, 156C, and 156K used as primary transfer devices which transfer to the intermediate transfer body the yellow toner image, the magenta toner image, the cyan toner image, and the black toner image, which have respectively been formed on the photosensitive drums 102Y, 102M, 102C, and 102K, and a secondary transfer roller 158 used as a secondary transfer device which transfers to a paper the yellow toner image, the magenta toner image, the cyan toner image, and the black toner image, which have been transferred to the intermediate transfer body 142. Also, the transfer device 140 has a cleaning device 160 which cleans the surface of the intermediate transfer body 142.

The paper feeder 200 has, for example, a paper housing part 202 which uses a cassette, an extraction roller 204 for extracting paper which is located at the uppermost position and which is housed in the paper housing part 202, a conveying roller 206 which conveys the paper extracted by the extraction roller 204 toward the image forming part 100, and a separating roller 208 which comes into contact with the conveying roller 206 and separates papers between the separating roller and the conveying roller 206. The paper housing part 202 is configured to be able to be pulled out, for example, to the front side (the left side in FIG. 2) of the image forming apparatus body 20, and papers are replenished into the paper housing part 202 in a state where the paper housing part has been pulled out from the image forming apparatus body 20.

The conveyance path 250 has a main conveyance path 252, a reverse conveyance path 254, and an auxiliary conveyance path 256.

The main conveyance path 252 is a conveyance path which conveys a paper supplied from the paper feeder 200 toward the discharge part 22, and is mounted with a registration roller 260, the secondary transfer roller 158, the fixing device 116, and a discharge roller 262 in order from the upstream side in a paper conveying direction, along the main conveyance path 252. The registration roller 260 starts its rotation at a predetermined timing from a stopped state, and supplies a paper to a contact portion between the intermediate transfer body 142 and the secondary transfer roller 158 so as to match the timing at which a toner image is transferred to the intermediate transfer body 142.

A discharge roller 262 discharges the paper on which the toner image is fixed by the fixing device 116 to the discharge part 22. Also, when images are to be formed on both faces of a paper, the discharge roller 262 rotates in a direction opposite to a direction for the case where a paper is discharged to the discharge part 22, and supplies the paper on which an image is formed on one surface thereof to the reverse conveyance path 254 from its rear end side.

The reverse conveyance path 254 is used when the paper one surface of which an image is formed on is again supplied to the upstream of the registration roller 260 while the paper is inverted. Two reverse conveying rollers 264 and 264 are mounted along the reverse conveyance path 254.

The auxiliary conveyance path 256 is a conveyance path used when a paper is supplied from the front side of the image forming apparatus body 20 in a state where the paper-feed opening and closing part 26 is opened with respect to the image forming apparatus body 20. An auxiliary conveying roller 266 which conveys a paper toward the registration roller 260, and a separating roller 268 which is used to contact with the auxiliary conveying roller 266 so as to separate the papers, are mounted along the auxiliary conveyance path 256.

FIGS. 3 to 6 show the storage container 300.

As described above, the respective storage containers 300Y, 300M, and 300C have the same shape and size, and the storage container 300K has a larger capacity than the storage containers 300Y, 300M, and 300C. FIGS. 3 to 6 show the storage container 300 used as the storage containers 300Y, 300M, and 300C.

As shown in FIGS. 3 to 6, the storage container 300 has a container body 306, an opening and closing part 350, an operating member 380 used as an operating part, and a gear 370 used as a driving transmission part. A discharge hole 312 is formed at the position of the storage container 300 which becomes the bottom side in the direction of gravitational force in a state where the storage container is mounted to the image forming apparatus body 20 (refer to FIG. 1). The toner discharged from the discharge hole 312 is supplied to the developing device 110, and is used for formation of an image.

Additionally, a filling hole 314 which is used to fill toner into the container body 306 is formed at the position of the container body 306 which is directed upward in the direction of gravitational force in the state where the storage container is mounted to the image forming apparatus body 20. The filling hole 314 is formed in the upward surface of the container body 306, and toner is filled into the container body 306 via the filling hole 314 so as to be dropped from above in the direction of gravitational force. The shape of the filling hole 314 as seen from above in the direction of gravitational force is a substantially circular shape.

Additionally, a fixing projection 316 is formed on the front face of the container body 306 so as to project toward the front. The fixing projection 316 is used as a fixing part which fixes the operating member 380 to a third position which will be described later.

Figure 5:
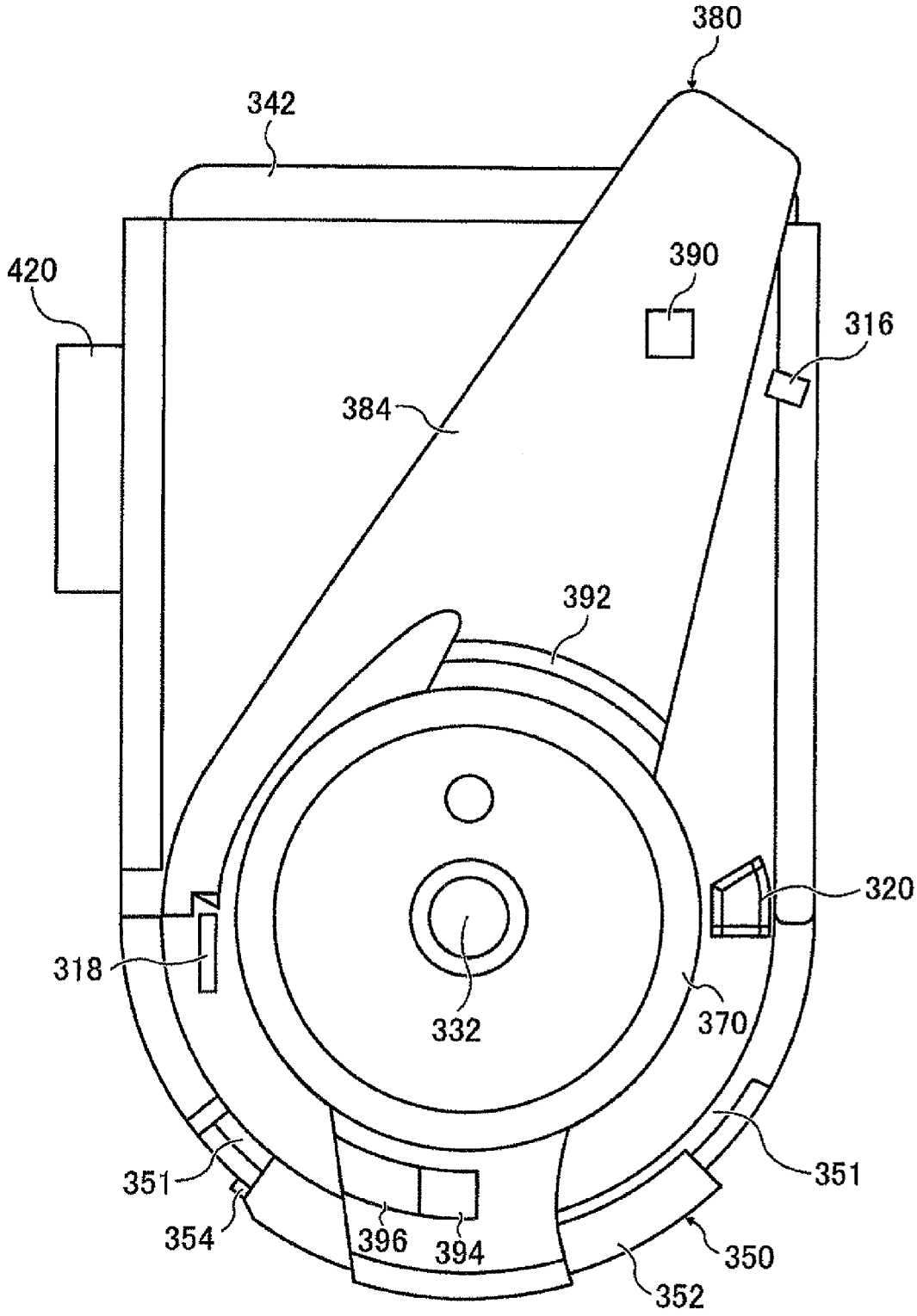
FIG. 5 is a side view showing the storage container according to the exemplary embodiment of the invention.

Additionally, a prohibiting projection 318 is formed on the front face of the container body 306 so as to project toward the front (refer to FIG. 5). The prohibiting projection 318 is used as a movement prohibiting part which prohibits the operating member 380 from moving to a first position which will be described later from a second position which will be described later. Additionally, the prohibiting projection 318 is used as an opening prohibiting part which prohibits the discharge hole 312 from being opened in a state where the container body 306 is not mounted to the image forming apparatus body 20.

Additionally, a protecting projection 320 is formed at a position on the front side of the container body 306 close to the gear 370 so as to project toward the front. The protecting projection 320 makes it hard for the face of the gear 370 on which teeth are formed to collide with other objects, thereby protecting the gear 370.

The inside of the container body 306 is mounted with a stirring device 330 used as a stirring part for stirring the toner stored within the container body 306. The stirring device 330 has a shaft 322 attached to the container body 306 so as to be rotatable about a rotary shaft 332, a parallel part 334 attached to the shaft 322 and substantially parallel to the shaft 322, and a stirring plate 336 attached to the shaft 322. The stirring plate 336 is made of an elastic film-like sheet, and is adapted so that its distal end comes into contact with an internal face of the container body 306.

Additionally, a cylindrical supporting projection 324 which is used to rotatably support the operating member 380 is formed on the rear face of the container body 306. Additionally, a supporting projection (not shown) which is used to rotatably support the operating member 380 is formed on the front face of the container body 306 similarly to the supporting projection 324.

Figure 6:
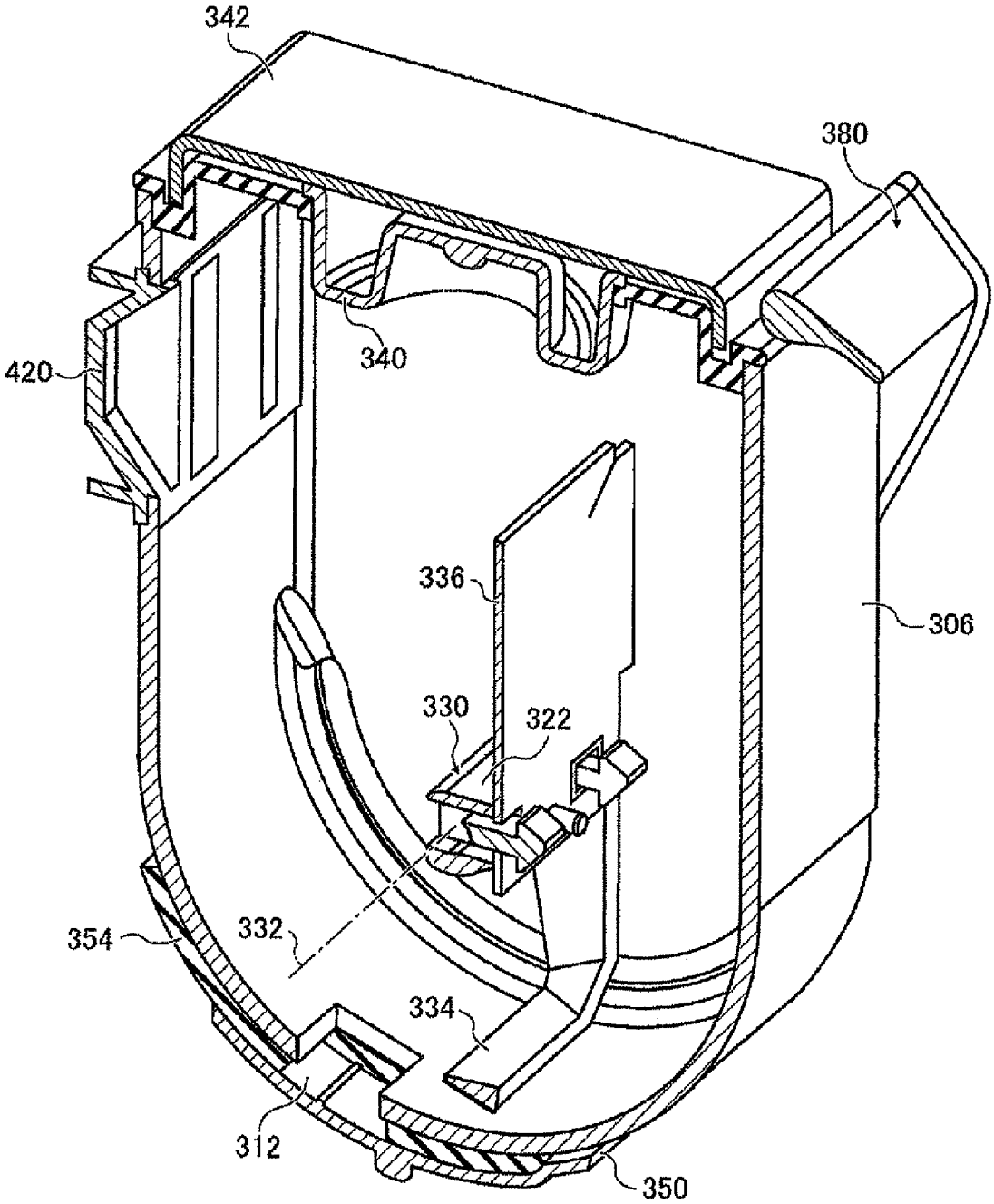
FIG. 6 is a perspective view showing the section of the storage container according to the exemplary embodiment of the invention.

Additionally, as shown in FIG. 6, the stirring device 330 can be arranged so that its longitudinal direction may coincide with a vertical direction which is a direction in which toner is stored into the container body 306 via the filling hole 314. If toner is filled into the container body 306 in a state where the stirring device 330 has been arranged in such a position, the movement of the toner downward from above is hardly hindered by the stirring device 330, and the storage of the toner into the oblong container body 306 in the vertical direction can be performed well.

Additionally, the left face of the container body 306 is mounted with an identification member 420 used as an identification part. The identification member 420 has a plurality of (for example, three) convex portions 422, and a concave portion 424 is formed between the convex portions 422 which are adjacent to each other. The concave portions 424 are formed so that at least any one of the number, position, and width thereof differs according to the kind of toner stored within the container body 306. At least any one of the number, position, and width of the concave portions 424 differs according to, for example, whether the color of toner stored within the container body 306 is yellow, magenta, or cyan. Additionally, even when, for example, a black toner which is the same color is stored, when toners used for different kinds of models are stored, or when toners having different characteristics are stored, at least one of the number, position, and width of the concave portions 424 differs according to the model and characteristics.

Additionally, printing or the like that an operator or the like identifies the kind of a toner to be filled or a filled toner is performed on the identification member 420. This printing or the like is arranged at a position which can be viewed in a state where the operating member 380 is arranged at least at a second position which will be described later. Additionally, this printing or the like is also arranged on the operating member 380 or the upper face of a lid member 340 which will be described later.

Additionally, a storage medium 450 used as a storage part is mounted to the rear face of the container body 306 so as to be attachable to and detachable from the container body 306. The storage medium 450 can be connected to a data writing device (not shown) provided on the side of the image forming apparatus body 20, and data, such as the number of images formed using the toner stored within the storage container 300, is written in from the data writing device. Connecting terminals 451 of the storage medium 450 extend long in the vertical direction, and are provided so that their lower portions including lower ends in the vertical direction are exposed, and four connecting terminals are aligned in the right-and-left horizontal direction. As described later in detail, in the state of FIG. 4 where the opening and closing part 350 connected to the operating member 380 has closed the discharge hole 312 (a state where the operating member 380 is at the second position), a lower portion (on the side of the opening and closing part 350) of a rear arm portion 386 of the operating member 380 retreats from the lower portions of the connecting terminals of the storage medium 450.

The opening and closing part 350 is attached so as to be movable to a lower side position of the container body 306. As the opening and closing part 350 moves with respect to the container body 306, the discharge hole 312 is brought into an opened state or is brought into a closed state. The opening and closing part 350 has an opening and closing member 352 which is mounted so as to be movable with respect to the container body 306, and a sealing member 354 which is provided between the opening and closing member 352 and the container body 306 and is used to seal the discharge hole 312.

The operating member 380 has a facing portion 382 which is arranged at a position which faces the filling hole 314, a front arm portion 384 which extends from a front end of the facing portion 382, and a rear arm portion 386 which extends from a rear end of the facing portion 382. A through hole (not shown) is formed in the front arm portion 384 so that the supporting projection (not shown) formed on the front side of the container body 306 fits thereinto. A through hole 408 is formed in the rear arm portion 386 so that the supporting projection 324 formed on the rear face of the container body 306 fits thereinto.

The operating member 380 is supported so as to be rotatable about the rotary shaft 322 such that the supporting projection formed on the front face of the container body 306 is inserted into the through hole formed in the front arm portion 384, and the supporting projection 324 is inserted into the through hole 408, and can be moved between a first position, a second position, and a third position, which will be described later.

A through hole 390 is formed in the front arm portion 384. The through hole 390 is formed at a position where the fixing projection 316 fits in a state where the operating member 380 is arranged at the third position which will be described later. For this reason, the operating member 380 is fixed to the third position with respect to the container body 306 by the through hole 390 and the fixing projection 316.

Additionally, a protecting projection 392 is formed on the front arm portion 384 so as to be located above the gear 370. The protecting projection 392 protects the face of the gear 370 on which teeth are formed, and keeps an operator from touching the gear 370 in a state where the storage container 300 is mounted to the inside of the image forming apparatus body 20.

Additionally, a guiding projection 394 is formed at the lower end of the front arm portion 384 and at the distal end in a direction in which the storage container 300 is inserted into the image forming apparatus body 20. The guiding projection 394 is fitted into the guide groove 46 (refer to FIG. 14) formed on the side of the image forming apparatus body 20, and guides the attachment and detachment of the storage container 300 into the image forming apparatus body 20.

Additionally, a collision suppressing projection 396 is formed, for example, continuously with the guiding projection 394 at the lower end of the front arm portion 384 and at the distal end in a direction in which the storage container 300 is inserted into the image forming apparatus body 20. The collision suppressing projection 396 also makes it hard for the face of the gear 370 on which teeth are formed to collide with the image forming apparatus body 20 when the storage container 300 is inserted into the image forming apparatus body 20. In addition, similarly to the collision suppressing projection 396, the guiding projection 394 also has a function to make it hard for the face of the gear 370 on which teeth are formed to collide with the image forming apparatus body 20.

A guiding projection 402 is formed at the lower end of the rear arm portion 386 similarly to the case where the guiding projection 394 is formed on the front arm portion 384. The guiding projection 402 is fitted into the guide groove 44 (refer to FIG. 14) formed on the side of the image forming apparatus body 20, and guides the attachment and detachment of the storage container 300 into the image forming apparatus body 20.

The operating member 380 and the opening and closing member 352 are connected together. That is, the portion of the front arm portion 384 at the lower end thereof is connected to the front portion of the opening and closing member 352, and the portion of the rear arm portion 386 at the lower end thereof is connected to the rear portion of the opening and closing member 352. For this reason, the operating member 380 moves interlocking with the opening and closing member 352.

Since the gear 370 is mounted to the front face of the container body 306, when the storage container 300 is mounted to the image forming apparatus body 20, the gear is connected to a gear (not shown) provided on the side of the image forming apparatus body 20 to receive the driving transmission from this gear. Additionally, the gear 370 is connected to the portion of the shaft 322 which projects out of the container body 306. For this reason, when driving is transmitted to rotate the gear 370, the stirring device 330 is rotated within the container body 306, and the toner stored within the container body 306 is stirred.

The storage container 300 has a lid member 340 used as a sealing part which seals the filling hole 314 in addition to having the container body 306, the opening and closing part 350, the operating member 380, and the gear 370. The lid member 340 is mounted to the container body 306 so as to fit into the filling hole 314 after toner is filled into the container body 306 via the filling hole 314. When the lid member 340 is mounted, the filling hole 314 is sealed, and toner is prevented from spilling out from the filling hole 314 irrespective of the direction of the container body 306.

Additionally, the storage container 300 has a cover member 342. The cover member 342 is attached to the container body 306 so as to cover the lid member 340 mounted to the container body 306 from the outside. When the cover member 342 is attached, for example, even if the lid member 340 is going to get out of the filling hole 314, the lid member 340 is prevented from completely coming off from the filling hole 314, and the cover member 342 keeps the toner spilled out from the container body 306 through the filling hole 314 from spreading to the outside.

The operation of the operating member 380 will be described in FIGS. 7A to 8C.

Figure 7A:
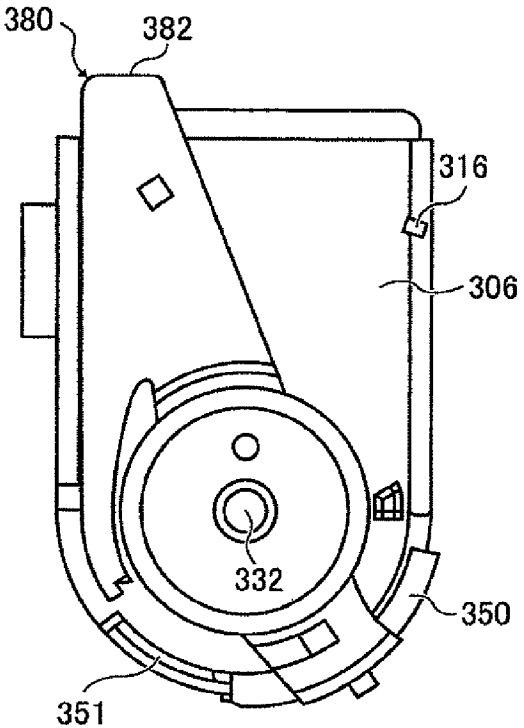
FIGS. 7A to 7C illustrate the movement of an operating member of the storage container according to the exemplary embodiment of the invention, and specifically.
Figure 7B:
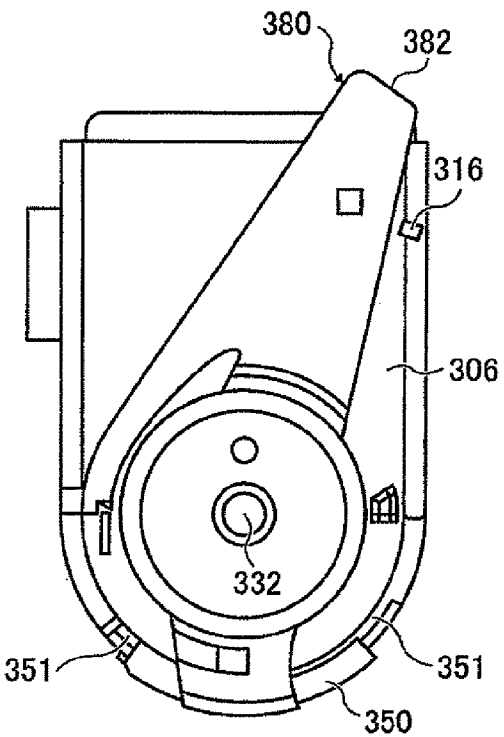
Figure 7C:
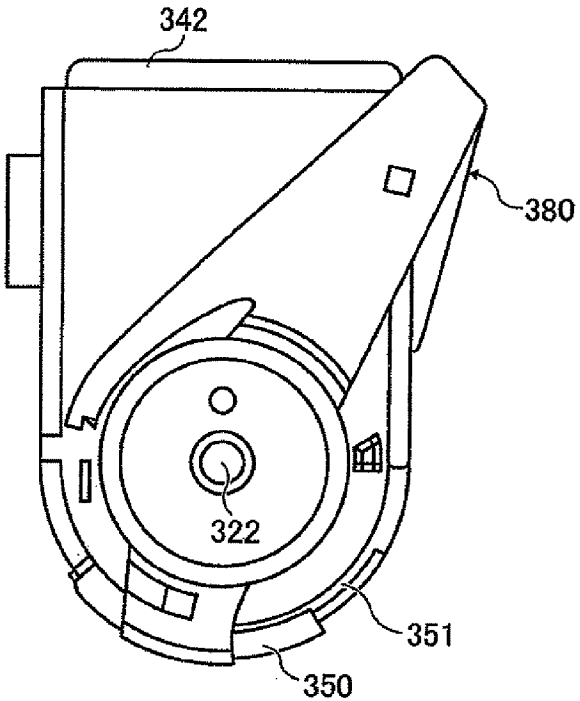
Figure 8A:
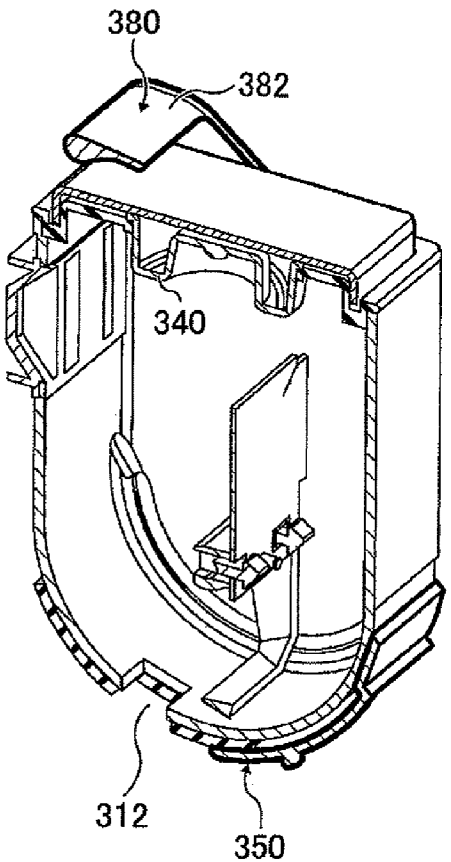
FIGS. 8A to 8C illustrate the movement of the operating member of the storage container according to the exemplary embodiment of the invention, and specifically.
Figure 8B:
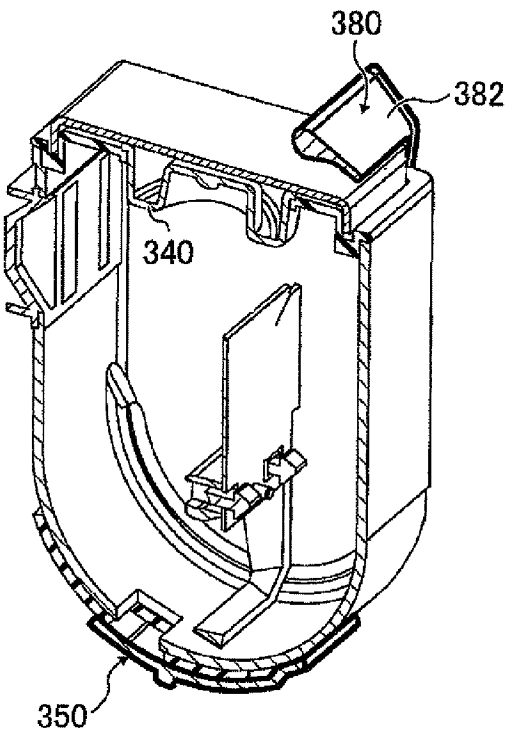
Figure 8C:
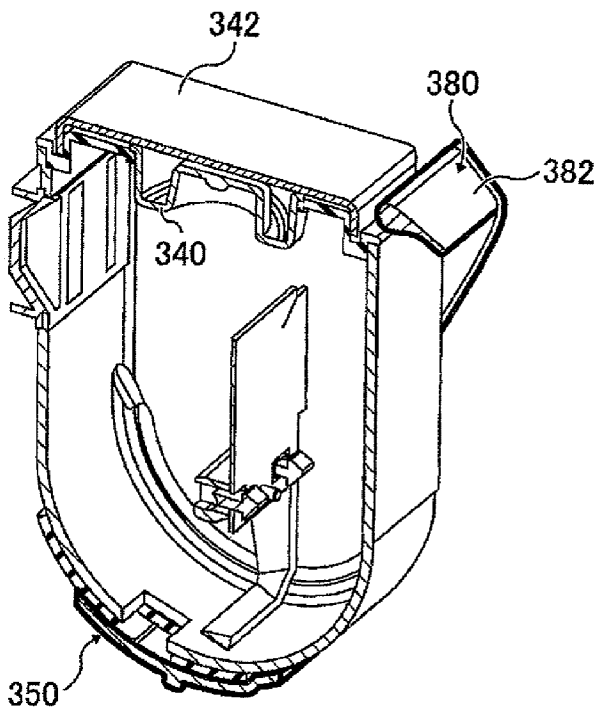

The operating member 380 can be moved between the first position shown in FIGS. 7A and 8A, the second position shown in FIGS. 7B and 8B, and the third position shown in FIGS. 7C and 8C.

The first position shown in FIGS. 7A and 8A is a position where the discharge hole 312 formed in the container body 306 is brought into an opened state. That is, when the operating member 380 is at the first position, the opening and closing part 350 connected to the operating member 380 is brought into a state of being arranged at a position apart from the discharge hole 312. When the storage container is mounted to the inside of the image forming apparatus body 20 to supply toner to the developing device 110, the operating member 380 is operated so as to be brought into a state of being arranged at the first position.

The second position shown in FIGS. 7B and 8B is a state where the discharge hole 312 is closed, and a state of being arranged at a position where the facing portion of the operating member 380 overlaps the container body 306 in the direction (vertical direction in this exemplary embodiment) in which the lid member 340 is attached to the container body 306. When the operating member 380 is at the second position, the opening and closing part 350 connected to the operating member 380 is brought into a state of being arranged at the position where the opening and closing part 350 covers the discharge hole 312, and is brought into a state where the discharge hole 312 is blocked.

The third position shown in FIGS. 7C and 8C is a state where the discharge hole 312 is closed, and a state of being arranged at a position where the facing portion of the operating member 380 does not overlap the container body 306 in the direction (vertical direction in this exemplary embodiment) in which the lid member 340 is attached to the container body 306. When the operating member 380 is at the third position, the opening and closing part 350 connected to the operating member 380 is brought into a state of being arranged at the position where the opening and closing part covers the discharge hole 312, and is brought into a state where the discharge hole 312 is blocked. Since the operating member 380 and the opening and closing part 350 are connected together, when the operating member 380 is moved to the third position from the second position, the opening and closing part 350 also moves with the movement of the operating member 380. However, since the size of the opening and closing part 350 is formed so as to be greater than the size of the discharge hole 312, the opening and closing part 350 moves still in a state where the discharge hole 312 is blocked, i.e., in a state where the sealing member 354 of the opening and closing part 350 seals the discharge hole 312. Additionally, when the operating member 380 is at the third position, the facing portion 382 is brought into a state where the facing portion does not overlap the container body 306, in the vertical direction which is the direction where the lid member 340 is attached to the container body 306.

In addition, in order for the opening and closing part 350 to move with respect to the container body 306, the container body 306 is provided with an opening and closing part guide groove 351 which serves as a guide part which guides the opening and closing part 350. The opening and closing part guide groove 351 is provided so as to extend in both the opening and closing directions of the opening and closing part 350, i.e., not only in the opening direction of the opening and closing part 350 but also in the closed direction of the opening and closing part 350, when the opening and closing part 350 is at the second position. When the opening and closing part 350 is moved to the second position and the third position, the opening and closing part 350 is guided into the opening and closing part guide groove 351 while being kept in a state where the sealing member 354 of the opening and closing part 350 seals the discharge hole 312.

When the storage container 300 is mounted to the inside of the image forming apparatus body 20 in a state where the operating member 380 is at the third position, the operating member 380 and the image forming apparatus body 20 interfere with each other. That is, the operating member 380 is used as an interference part which interferes with the image forming apparatus body 20 when the storage container 300 is mounted to the inside of the image forming apparatus body 20 in a state where the operating member 380 is at the third position.

When the operating member 380 is at the third position and toner is filled into the container body 306, it is difficult for the facing portion 382 to hinder the movement (fall) of the toner. Additionally, when the operating member 380 is at the third position, it is difficult for the lid member 340 to become a hindrance when attached to the container body 306 by pushing-in, such as position aligning or capping, and the attachment of the lid member 340 to the container body 306 is easily performed. Additionally, when the operating member 380 is at the third position, in the direction (vertical direction in this exemplary embodiment) in which the lid member 340 is attached to the container body 306, it is difficult for the cover member 342 to become a hindrance when attached to the container body 306 by aligning, etc., and the attachment of the cover member 342 to the container body 306 is easily performed. After the operating member 380 is arranged at the third position to fill toner into the container body 306, the filling hole 314 of the container body 306 is closed by the lid member 340, and the cover member 342 is attached to the container body 306 so as to cover the lid member 340.

Figure 9:
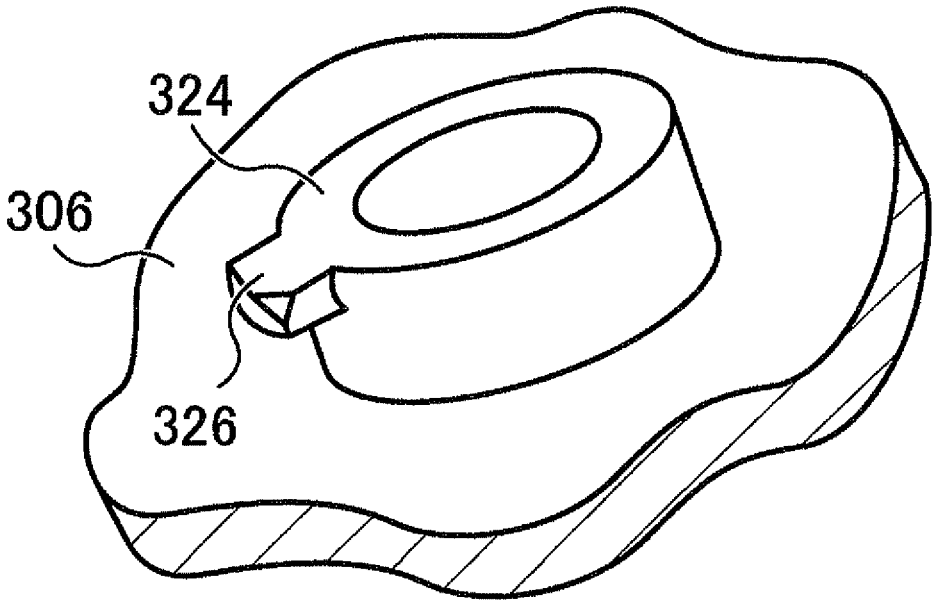
FIG. 9 is a perspective view showing a projection formed on a main body of the storage container according to the exemplary embodiment of the invention in order to rotatably support the operating member.

The supporting projection 324 (refer to FIG. 4) is shown in FIG. 9.

As mentioned above, the supporting projection 324 is formed on the front face of the container body 306, is substantially cylindrical, and is press-fitted into the through hole 408 formed in the rear arm portion 386 of the operating member 380 to support the operating member 380 so that the operating member 380 can be rotated with respect to the container body 306.

A protruding portion 326 which is a portion of the supporting projection 324 in a circumferential direction and which protrudes in the circumferential direction is provided at a position apart from the front face of the container body 306.

Figure 10:
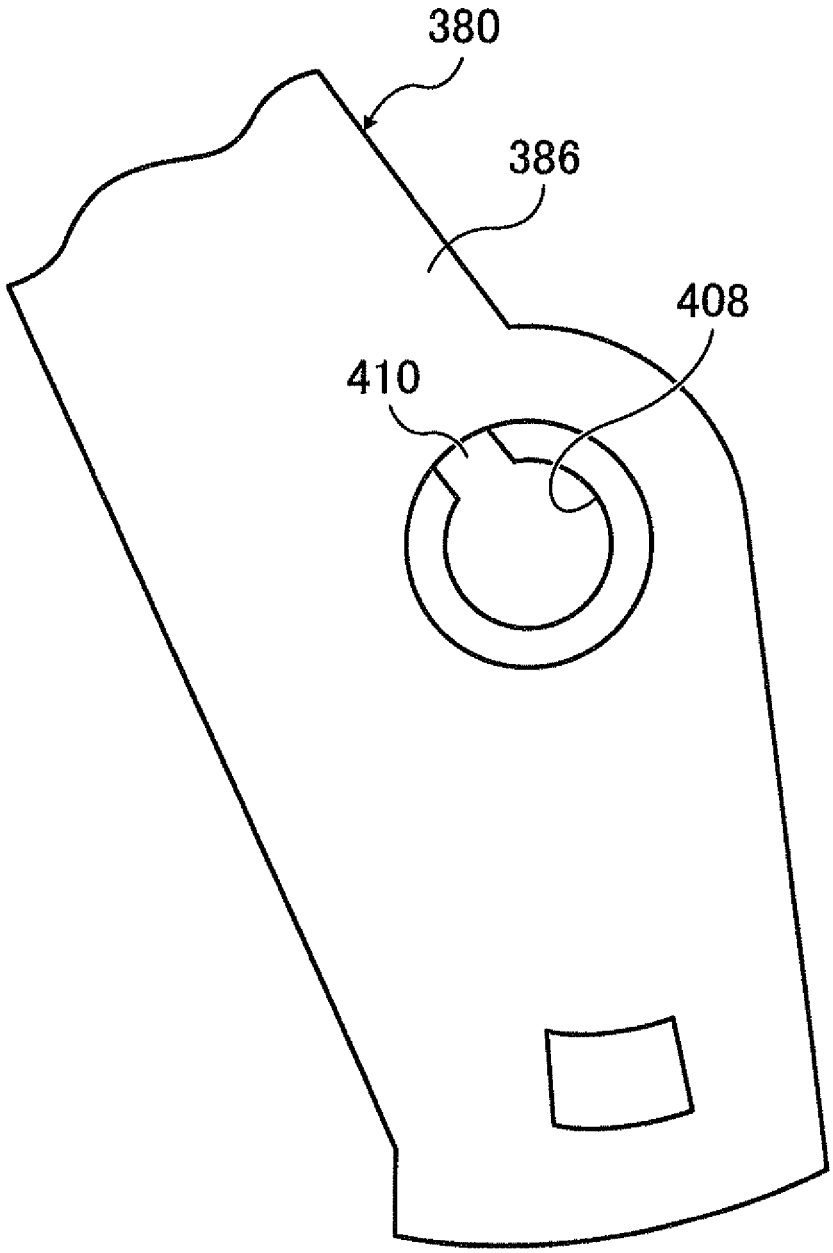
FIG. 10 is a side view showing the shape of a through hole formed in the operating member of the storage container according to the exemplary embodiment of the invention.

A portion in which the through hole 408 of the rear arm portion 386 of the operating member 380 is formed is shown in an enlarged manner in FIG. 10. As shown in FIG. 10, a large-diameter portion 410 is formed at a portion of the through hole 408 in the circumferential direction so that the diameter of the hole is made greater than other portions. The large-diameter portion 410 is formed so that the protruding portion 326 of the supporting projection 324 is fitted thereinto when the supporting projection 324 is inserted into through hole 408. For this reason, the operating member 380 can be mounted to the container body 306 only when the large-diameter portion 410 has a positional relationship of entering the protruding portion 326. The position of the operating member 380 which can be mounted to the container body 306 becomes the third position (refer to FIGS. 7C and 8C). That is, the operating member 380 is brought into a state of being arranged at the third position when mounted to the container body 306.

Figure 11B:
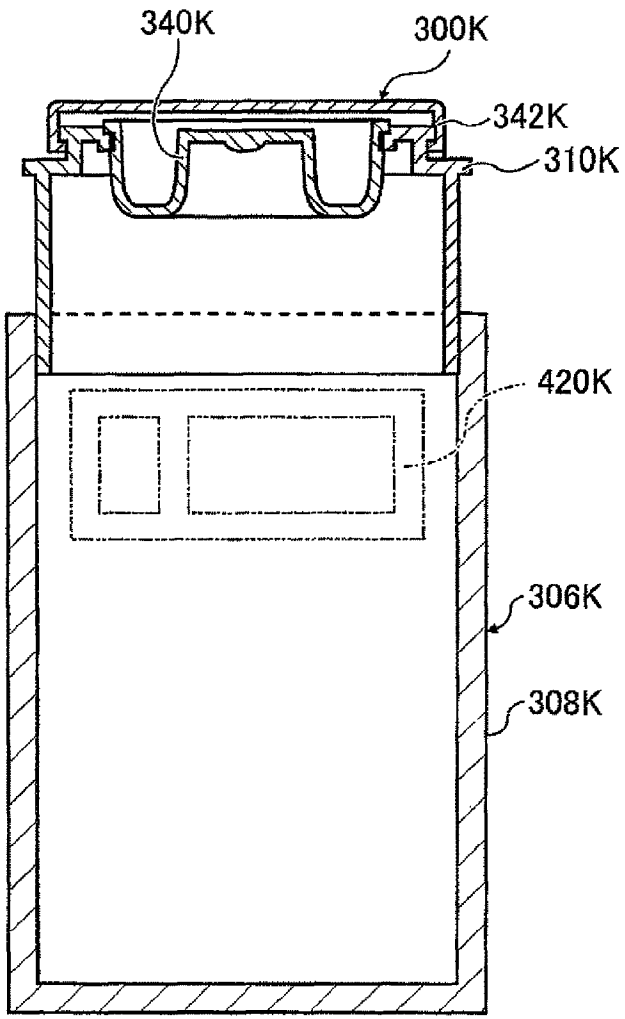
FIG. 11B is a sectional view showing a storage container according to the exemplary embodiment of the invention, and schematically showing a storage container used for the storage of a black toner.
Figure 11A:
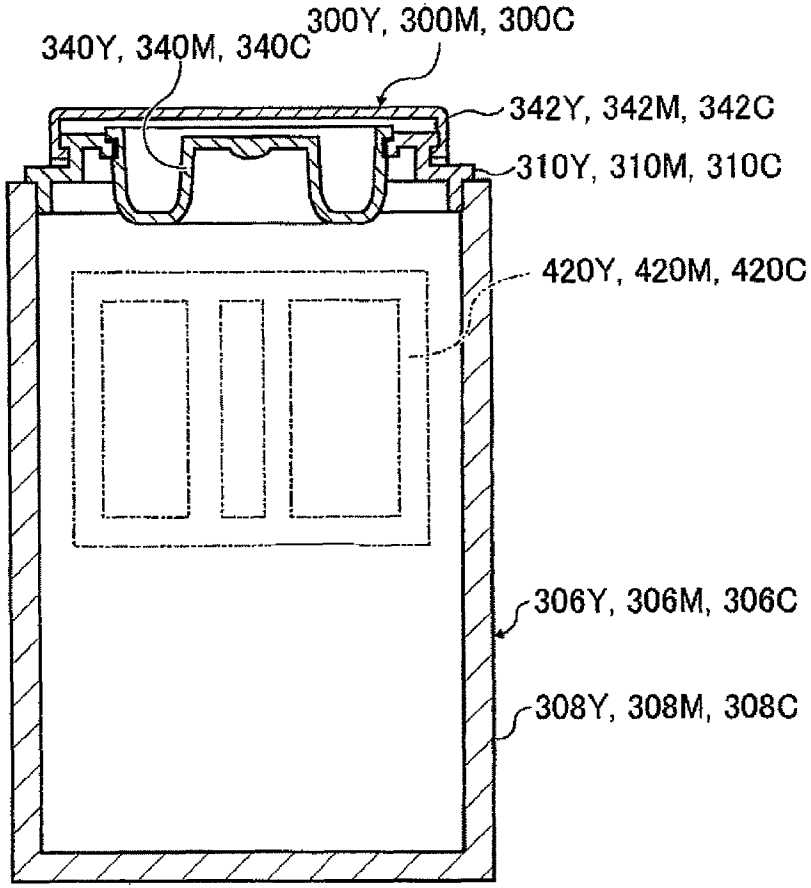
FIG. 11A is a sectional view showing storage containers of the exemplary embodiment of the invention, and schematically showing storage containers used for the storage of a yellow toner, a magenta toner, and a cyan toner.

A sectional view of storage containers 300Y, 300M, and 300C is shown in FIG. 11A, and a sectional view of a storage container 300K is shown in FIG. 11B. As mentioned above, the volume of the storage container 300K is greater than the volume of the storage containers 300Y, 300M, and 300C.

As shown in FIGS. 11A and 11B, storage container body 306Y, 306M, 306C, and 306K are formed so that lower containers 308Y, 308M, 308C, and 308K are mounted to upper containers 310Y, 310M, 310C, and 310K, respectively. As for the size of the lower containers 308, the lower containers 308Y, 308M, and 308C for a yellow toner, a magenta toner, and a cyan toner have the same size and shape as the lower container 308K for a black toner. For this reason, a common part is used as the lower containers 308 for a yellow toner, a magenta toner, a cyan toner and a black toner.

As for the size of the upper containers 310, the upper container 310K for a black toner is greater than the upper containers 310Y, 310M, and 310C for a yellow toner, a magenta toner, and a cyan toner, and toner can be stored inside the upper container 310K for a black toner in a state where the upper container is mounted to the lower container 308K.

Additionally, the size of identification members 420Y, 420M, and 420C is greater than the size of an identification member 420K. Thereby, the heights of lower ends of the identification members 420Y, 420M, and 420C and the height of a lower end of the identification member 420K become equal to each other when the storage containers 300Y, 300M, 300C, and 300K have been mounted to the inside of the image forming apparatus body 20 so that the height of the upper ends of the storage containers 300Y, 300M, and 300C and the upper end of the storage container 300K become equal to each other.

Figure 12:
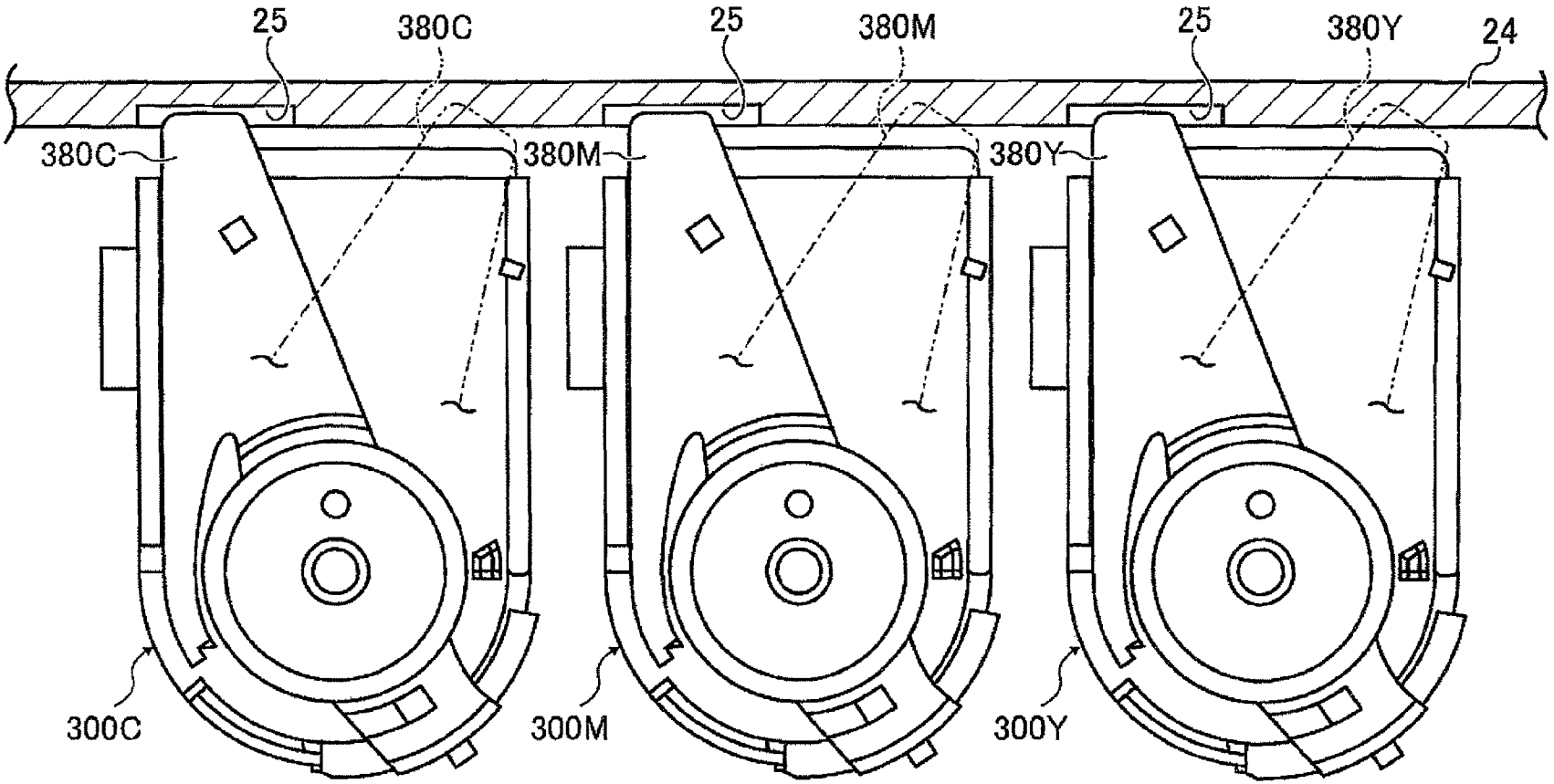
FIG. 12 is a sectional view showing the shape of a mounting opening and closing part used for the image forming apparatus according to the exemplary embodiment of the invention.

The section of an opening and closing part 24 for mounting in a state where the opening and closing part is closed with respect to the image forming apparatus body 20 is shown in FIG. 12.

The opening and closing part 24 for mounting is formed with four concave portions 25 which correspond to the number of the storage containers 300 which are mounted to the inside of the image forming apparatus body 20 (three containers are shown in FIG. 12). The four concave portions 25 are formed so that upper end sections of the operating members 380 arranged at the first positions of the storage containers 300 mounted to the inside of the image forming apparatus body 20 enter the concave portions, respectively. On the other hand, as shown by two-dot chain lines in FIG. 12, when the operating members 380 are arranged at the second positions, the opening and closing part 24 for mounting interferes with the upper end of the operating member 380. That is, if the operating members 380 of all the storage containers 300 mounted to the inside of the image forming apparatus body are not in a state where the operating members are arranged at the first positions, the opening and closing part 24 for mounting cannot be closed with respect to the image forming apparatus body 20.

For this reason, when the storage container 300 has been mounted to the inside of the image forming apparatus body 20, the operation of moving the operating member 380 to the first position is reliably performed, the discharge hole 312 formed in the storage container 300 is reliably opened, and toner is reliably supplied into the developing device 110 from the storage containers 300. An opening and closing sensor which detects the opening and closing of the opening and closing part 24 for mounting may be provided, and when the opening and closing sensor has detected that the opening and closing part 24 for mounting is opened, for example, warning may be displayed on the operation panel 12, or an image formation operation may be inhibited.

Figure 13:
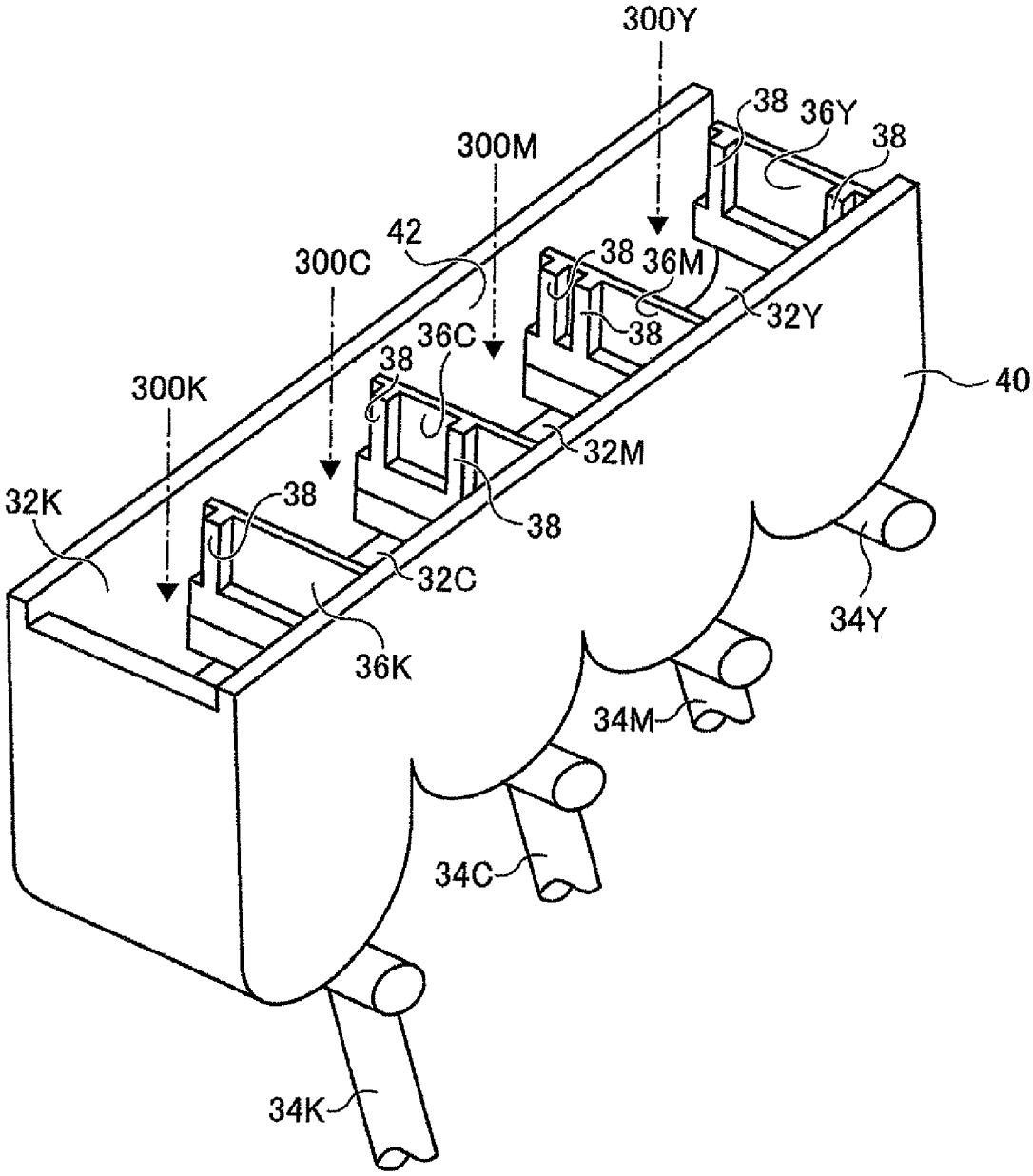
FIG. 13 is a first perspective view showing a mounting part which is formed in an apparatus main body of the image forming apparatus according to the exemplary embodiment of the invention and which is mounted with the storage container.

FIG. 13 is a perspective view of the mounting device 30.

The mounting device 30 has a right side plate 40, a left side plate 42, and connecting plates 36Y, 36M, 36C, and 36K which connect the right side plate 40 with the left side plate 42, and mounting chambers 32Y, 32M, 32C, and 32K of which the top is opened are formed by these members, respectively. The storage containers 300Y, 300M, 300C, and 300K are mounted to the mounting chambers 32Y, 32M, 32C, and 32K, respectively, from above.

Toner conveyance passages 34Y, 34M, 34C, and 34K are attached to the bottoms of the mounting chambers 32Y, 32M, 32C, and 32K. The toner conveyance passages 34Y, 34M, 34C, and 34K are used, to convey the toners within the storage containers 300Y, 300M, 300C, and 300K to the developing devices 110Y, 110M, 110C, and 110K, respectively.

Since the connecting plates 36Y, 36M, 36C, and 36K are used as body-side identification part, respectively, a single or a plurality of convex portions 38 is formed in each connecting plate so that at least any one of the number, position, and width differs.

The convex portion 38 is formed with a size able to fit at a position where the convex portion fits into the concave portion 424 (refer to FIG. 4) provided in the storage container 300 to be mounted to each mounting chamber 32. For example, the convex portion 38 is formed on the mounting chamber 32Y so as to fit into the concave portion 424 formed in the storage container 300Y for yellow to be mounted to the mounting chamber 32Y. Here, as mentioned above, the position of the concave portion 424 formed in the storage container 300 differs depending on, for example, the kind of the toner stored in the storage container 300, such as the color of the toner. For this reason, although an appropriate storage container 300 to be mounted to a specific mounting chamber 32 can be mounted to the mounting chamber 32, even if an attempt to mount a storage container 300 which is not the storage container to be housed in the mounting chamber 32 and in which a different kind of toner is stored is made, the convex portion 422 of the storage container 300 and the convex portion 38 of the identification member 420 interfere with each other, so that the storage container 300 cannot be mounted to the mounting chamber 32.

Figure 14:
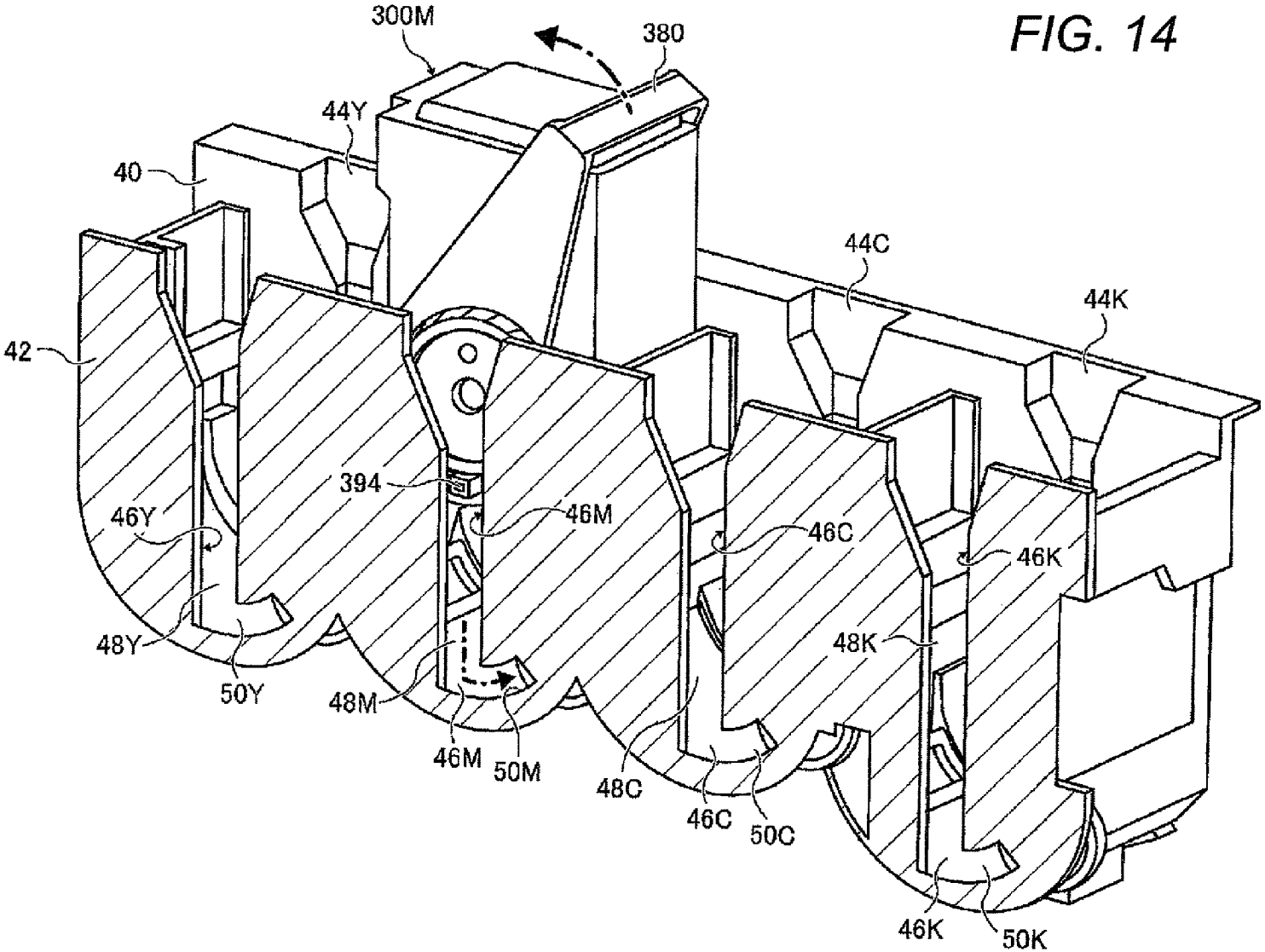
FIG. 14 is a second perspective view showing a mounting part which is formed in the apparatus main body of the image forming apparatus according to the exemplary embodiment of the invention and which is mounted with the storage container.

FIG. 14 is a sectional view of the mounting device 30.

As shown in FIG. 14, four guide grooves 44Y, 44M, 44C, and 44K are formed in the right side plate 40 of the mounting device 30. The guiding projections 402 (refer to FIG. 4) are fitted into the guide grooves 44Y, 44M, 44C, and 44K, respectively, and guide the mounting of the storage containers 300Y, 300M, 300C, and 300K, when the storage containers 300Y, 300M, 300C and 300K are mounted to the mounting chambers 32Y, 32M, 32C, and 32K, respectively.

Four guide grooves 46Y, 46M, 46C, and 46K are formed in the left side plate 42. The guiding projections 394 (refer to FIG. 3) are fitted into the guide grooves 46Y, 46M, 46C, and 46K, respectively, and guide the mounting of the storage containers 300Y, 300M, 300C, and 300K to the mounting chambers 32, respectively, when the storage containers 300Y, 300M, 300C, and 300K are mounted to the mounting chambers 32Y, 32M, 32C, and 32K, respectively. Each guide groove 44 has a mounting direction guide portion 48 which is wide on the side of an entrance, becomes gradually narrower toward the mounting direction of the storage container 300, and then has the same width, and a circular-arc portion 50 which extends in a substantially circular-arc shape from the end of the mounting direction guide portion 48 at the deep side thereof. When the operating member 380 has been operated so as to move to the first position after the storage container 300 is mounted to the mounting chamber 32, the guiding projection 402 enters the circular-arc portion 50.

Each circular-arc portion 50 is used as a prohibition part which prohibits the storage container 300 from being taken out of the image forming apparatus body 20 in a state where the operating member 380 has been arranged at the first position. That is, even if the guiding projection 394 enters the circular-arc portion 50, and the storage container 300 is lifted up to take out the storage container 300, in a state where the operating member 380 is arranged at the first position, the guiding projection 394 interferes with the portion of the left side plate 42 which forms the circular-arc portion 50, so that the storage container 300 cannot be detached from the image forming apparatus body 20.

Figure 15B:
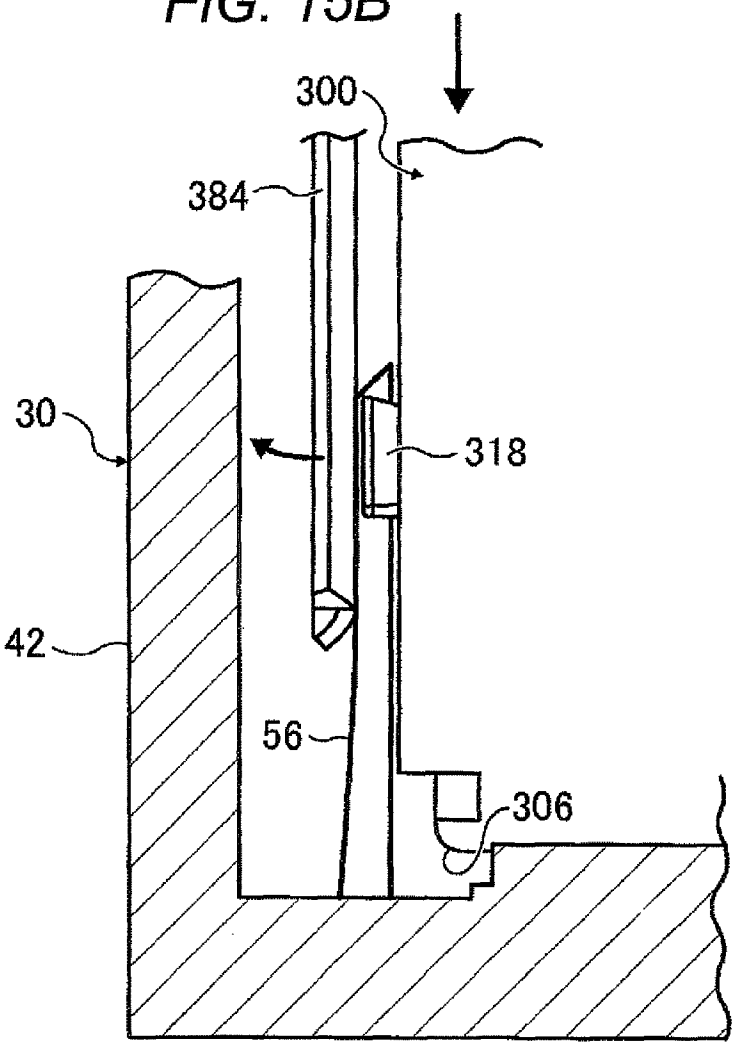
FIGS. 15A and 15B illustrate an aspect where the storage container is mounted to a mounting device.
Figure 15A:
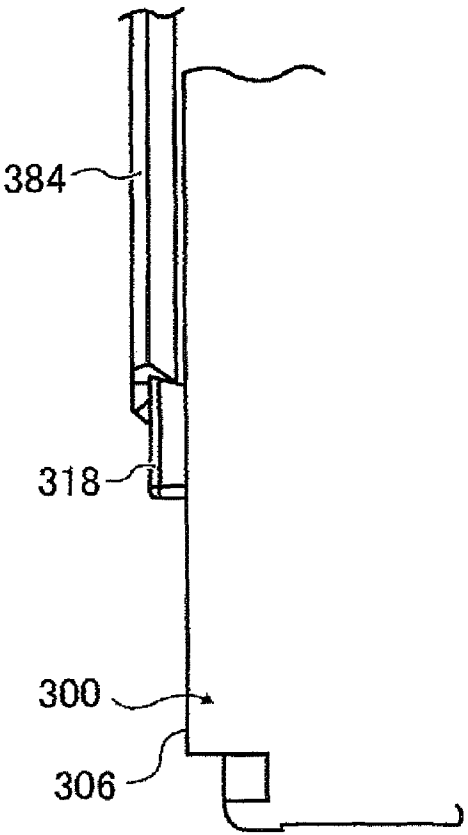

An aspect where the storage container 300 is mounted to the mounting device 30 is illustrated in FIGS. 15A and 15B, a right side view of the storage container 300 in a state where the operating member 380 has been arranged at the second position is shown in FIG. 15A, and the right side face of the storage container 300 and a sectional view of the mounting device 30 is shown in FIG. 15B.

As shown in FIG. 15A, when the storage container 300 is not mounted on the image forming apparatus body 20, a prohibiting projection 318 (also refer to FIG. 5) is at a position where the projection interferes with the locus of movement of the front arm portion 384 of the operating member 380 in a state where the operating member 380 has been arranged at the second position, so that the operating member 380 cannot be moved to the first position from the second position.

On the other hand, when the storage container 300 is inserted into the image forming apparatus body 20, as shown in FIG. 15B, an insertion member 56 provided so as to protrude upward from the bottom face of the mounting device 30 is inserted between the container body 306 and the front arm portion 384, and the front arm portion 384 deforms in a direction away from the container body 306, and moves to the position where the arm portion does not interfere with the prohibiting projection 318. For this reason, if the storage container 300 is mounted to the inside of the image forming apparatus body 20, the operating member 380 can be moved to the first position from the second position.

Figure 16:
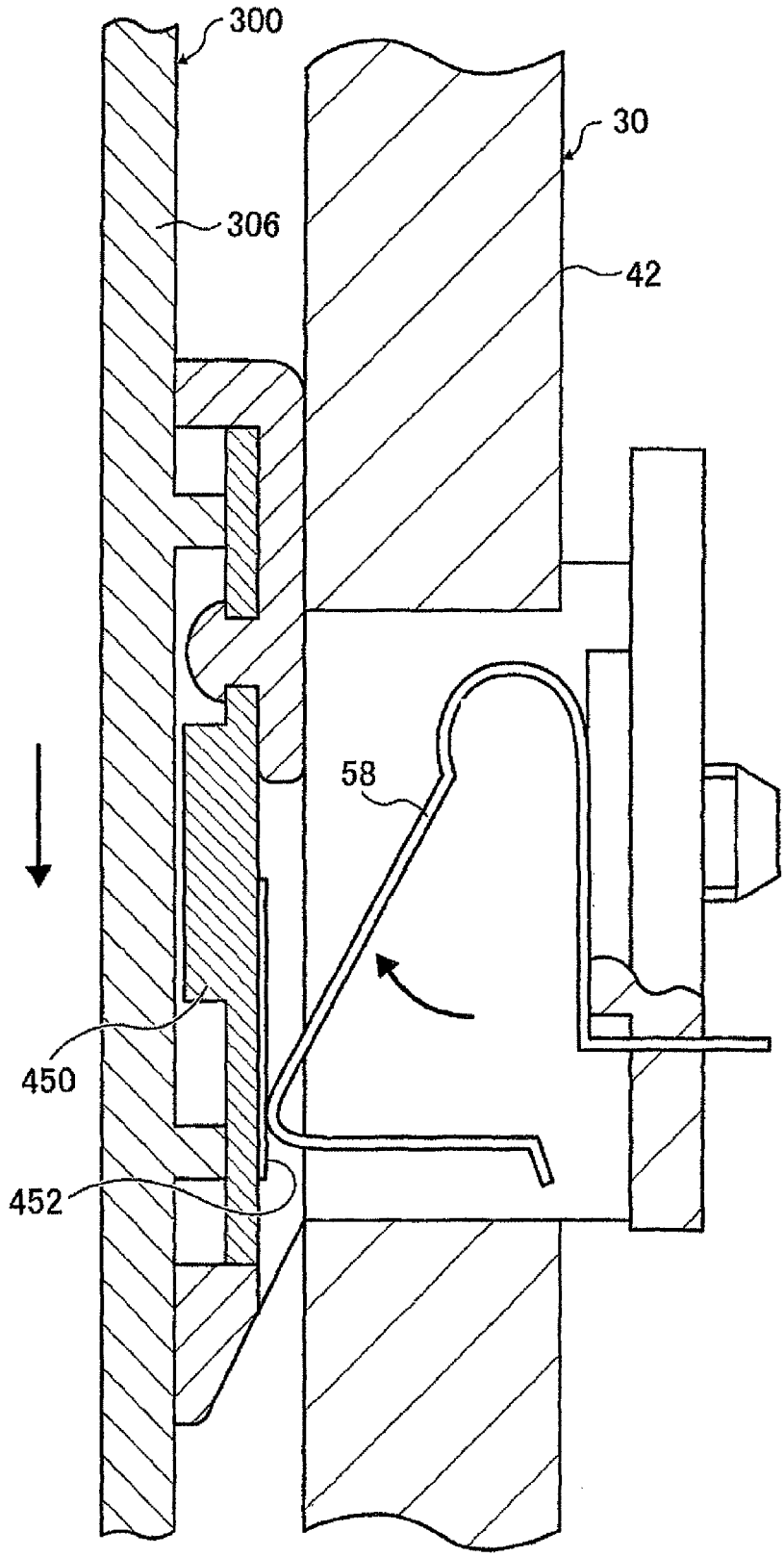
FIG. 16 is a sectional view illustrating a connection operation of a storage member provided in the storage container according to the exemplary embodiment of the invention, and a connecting part formed in the image forming apparatus body.

A configuration in which the storage medium 450 mounted to the storage container 300, and the image forming apparatus body 20 side are connected together in a state where the storage container has been mounted to the mounting device 30 is shown in FIG. 16. As shown in FIG. 16, since a deformable electrode 58 is mounted to the right side plate 40 of the mounting device 30, the image forming apparatus body 20 side and the storage medium 450 are connected together so that the electrode 58 is pressed against an electrode 452 of the storage medium 450.

Figure 17:
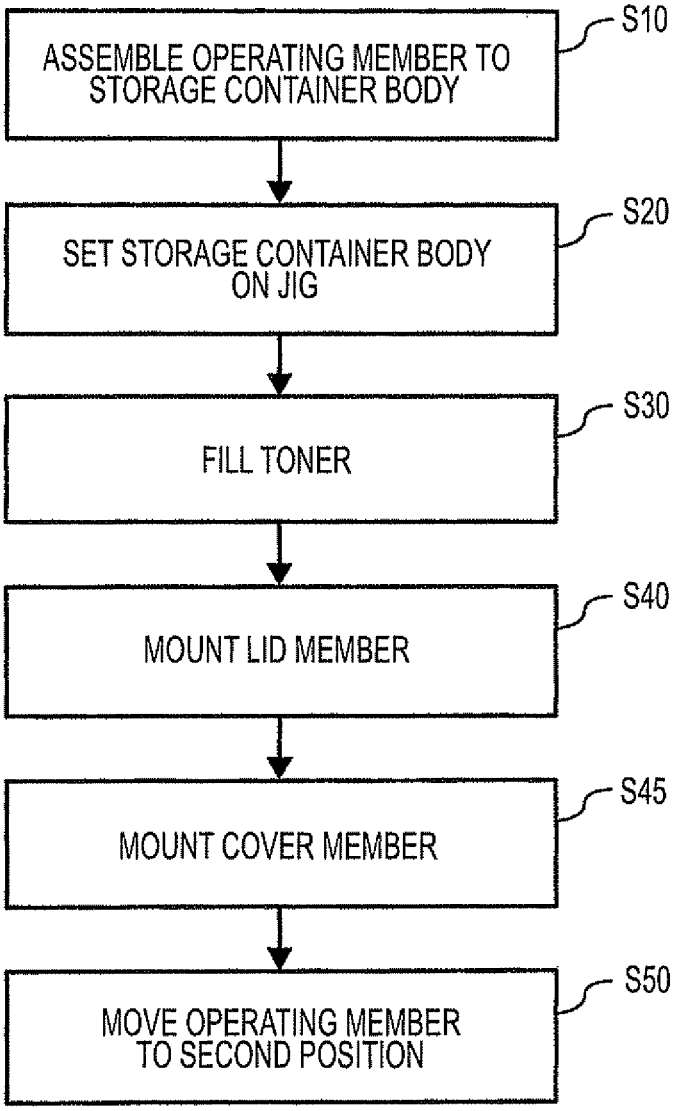
FIG. 17 is a view illustrating the process of filling toner into the storage container according to the exemplary embodiment of the invention.

For example, in the process of manufacture, the process of filling toner into the storage container 300 is illustrated in FIG. 17.

As shown in FIG. 17, in order to fill the storage container 300 with toner, in a first step S10, an operating member 380 is assembled in the container body 306. In this case, the protruding portion 326 which protrudes from the supporting projection 324 of the container body 306 is required to fit to the large-diameter portion 410 formed in the through hole 408 of the operating member 380, and the operating member 380 is assembled in the container body 306 so as to be located at the third position.

In this case, the operating member 380 is fixed to the third position such that the fixing projection 316 enters the through hole 390. For this reason, the operating member 380 is prevented from moving when toner is filled into the container body 306 in Step S30 which will be described later, and the poor filling of the toner by the moving of the operating member 380 hardly occurs.

In the next step S20, the container body 306 is set on a jig (not shown) so that the filling hole 314 is turned upward. In this case, the stirring device 330 is adjusted so that the longitudinal direction becomes the vertical direction.

In the next step S30, the toner is filled into the container body 306 so as to fall from above via the filling hole 314. In this case, since the operating member 380 is at the third position and the facing portion 382 of the operating member 380 is at a position which does not overlap the filling hole 314 in a direction (vertical direction) in which toner is filled, the operating member 380 does not become a hindrance of filling of toner.

Additionally, if the stirring device 330 is adjusted so that the longitudinal direction becomes the vertical direction, the falling of the toner within the container body 306 is hardly hindered, the toner easily reaches the bottom of the container body 306, and the toner is filled without making the space within the container body 306 useless.

In the next step S40, the lid member 340 is mounted on the filling hole 314 so as to be pushed in downward from above, and the filling hole 314 is sealed. In this case, since the operating member 380 is at the third position and the facing portion 382 of the operating member 380 is at a position which does not overlap the container body 306 in the direction (vertical direction in the current exemplary embodiment) in which the lid member 340 is attached to the container body 306, the operating member 380 does not hinder the lid member 340 from being mounted on the container body 306.

In the next step S45, the cover member 342 is mounted to the container body 306 from above so as to cover the lid member 340. In this case, since the operating member 380 is at the third position and the facing portion 382 of the operating member 380 is at a position which does not overlap the container body 306 in the direction (vertical direction in the current exemplary embodiment) in which the lid member 340 is attached to the container body 306, the operating member 380 does not hinder the cover member 342 from being mounted to the container body 306.

In the next step S50, the operating member 380 is moved to the second position from the third position. In order to move the operating member 380 to the second position, for example, the fixing projection 316 is detached from the through hole 390, for example, by deforming the front arm portion 384 of the operating member 380. By moving the operating member 380 to the second position, the facing portion 382 of the operating member 380 moves to a position which overlaps the container body 306 in a direction in which the lid member 340 is attached to the container body 306. In a direction which intersects the direction where the lid member 340 is attached to the container body 306, the width of the storage container 300 becomes small, and the conveyance of the storage container 300 becomes easy. Additionally, since even if an attempt to move the operating member 380 moved to the second position again to the third position is made, the front arm portion 384 of the operating member 380 and the fixing projection 316 come into contact with and interfere with each other, the operating member 380 is prevented from moving to the third position when there is no need.

Also, when the operating member 380 is moved to the second position from the third position, the operating member 380 may move to the first position from the second position erroneously, and the discharge hole 312 is brought into an open state. As a result, there is a possibility that toner may be discharged from the discharge hole 312. However, unless being mounted to the inside of the image forming apparatus body 20, the operating member 380 can be prevented from moving to the first position from the second position by the prohibiting projection 318.

Figure 18:
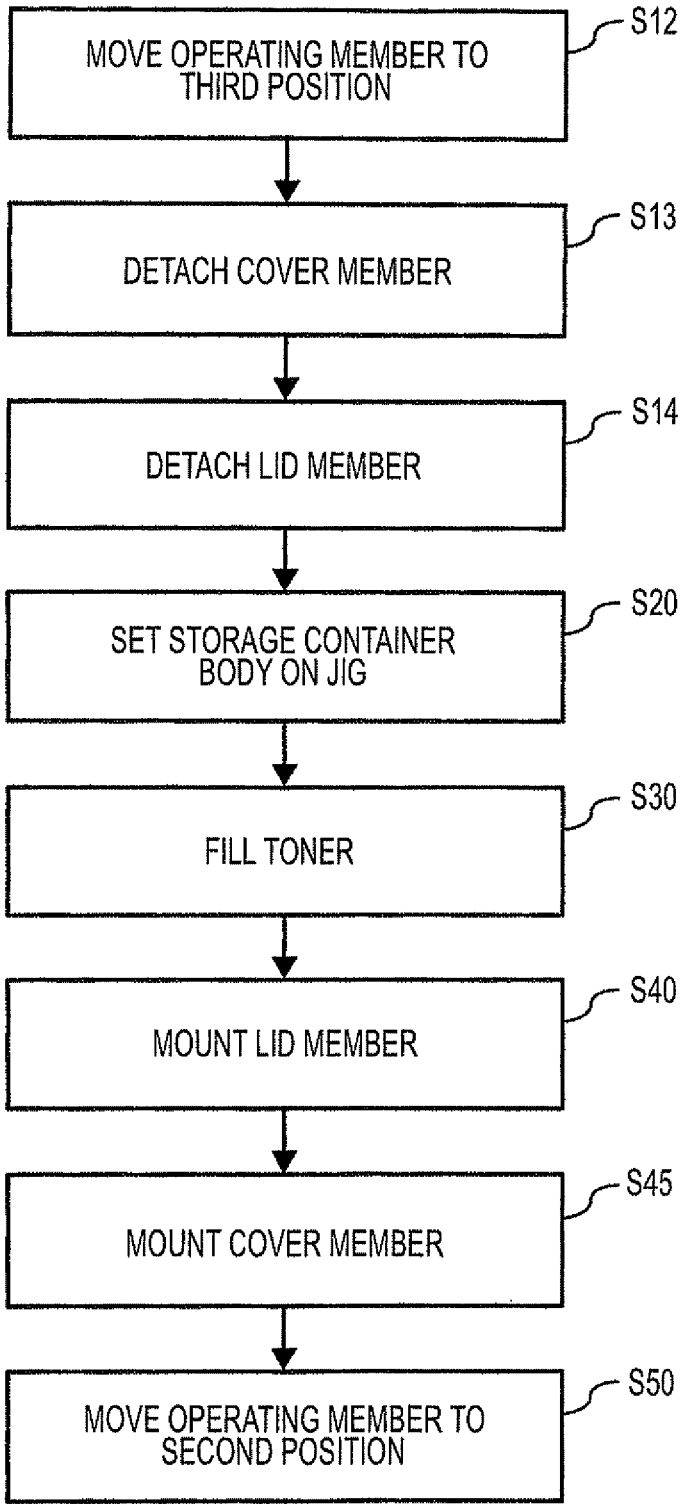
FIG. 18 is a view illustrating the process of refilling toner into the storage container according to the exemplary embodiment of the invention.

The process of filling toner again into a used storage container 300 is illustrated in FIG. 18.

As shown in FIG. 18, in a first step S12, the operating member 380 which is arranged at the second position in a collected state is moved to the third position. In this case, since the front arm portion 384 of the operating member 380 and the fixing projection 316 come into contact with and interfere with each other, the interference between the fixing projection 316 and the front arm portion 384 is avoided, for example, by deforming the front arm portion 384 of the operating member 380, and the fixing projection 316 is inserted into the through hole 390 by moving the operating member 380 to the third position.

In the next step S13, the cover member 342 is detached from the container body 306. In this case, since the operating member 380 is fixed to the third position, it is difficult for the operating member 380 to hinder the operation of detaching the cover member.

In the next step S14, the lid member 340 is detached from the container body 306. In this case, since the operating member 380 is fixed to the third position, it is difficult for the operating member 380 to hinder the operation of detaching the lid member 340.

In the next step S20, after cleaning, such as removing the toner remaining inside the container body 306, is performed if needed, similarly to the case where toner is filled into the storage container 300 as previously above, the storage container 300 is set to a jig. In a step 30, toner is filled into the container body 306. In the next step S40, the lid member 340 is mounted to the container body 306 so as to seal the filling hole 314. In the next step S45, the cover member 342 is mounted to the container body 306. In the next step S50, the operating member 380 is moved to the second position from the third position.

Figure 19:
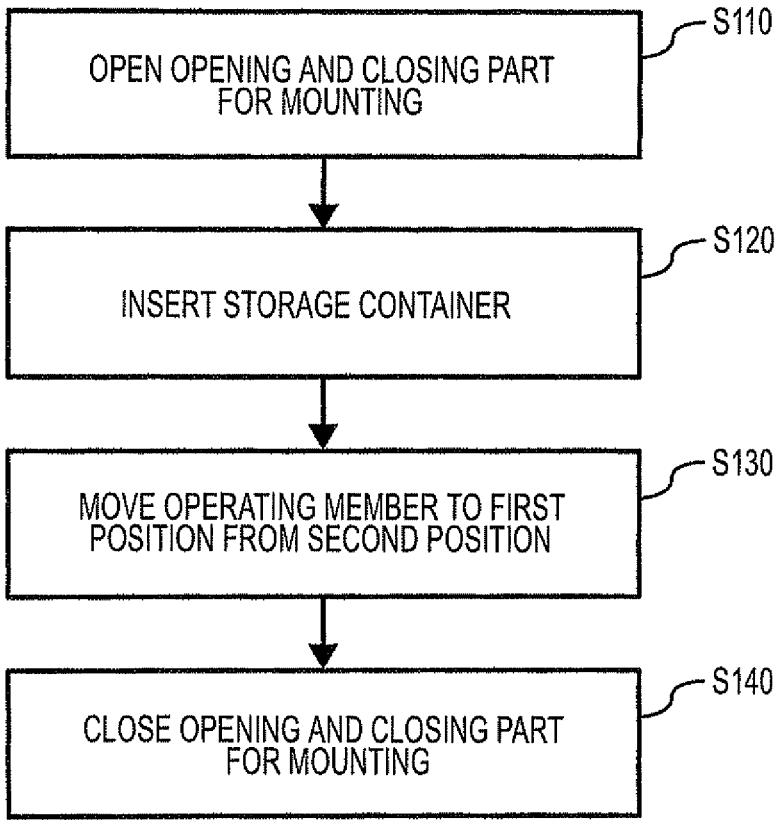
FIG. 19 is a view illustrating the process of mounting the storage container according to the exemplary embodiment of the invention to the image forming apparatus body.

The process of mounting the storage container 300 into the image forming apparatus body 20 is illustrated in FIG. 19. As shown in FIG. 19, in a first step S110, the opening and closing part 24 for mounting which is attached to the image forming apparatus body 20 is opened, and the top of the mounting device 30 is opened.

In the next step S120, the storage container 300 is inserted into the mounting device 30 within the image forming apparatus body 20 from above. In this case, the insertion member 56 provided so as to protrude upward from the bottom face of the mounting device 30 is inserted between the container body 306 and the front arm portion 384, and the front arm portion 384 deforms in a direction away from the container body 306, and moves to the position where the arm portion does not interfere with the prohibiting projection 318. For this reason, the operating member 380 can be moved to the first position from the second position.

In the next step S130, the operating member 380 is moved to the first position from the second position, and the discharge hole 312 is brought into an opened state. As a result, toner can be supplied to the developing device 110 from the storage container 300.

In the next step S140, the opening and closing part 24 for mounting is closed. In this case, if even one storage container where the operating member 380 does not move to the first position from the second position exists, the operating member 380 arranged at the second position and the opening and closing part 24 for mounting interfere with each other, so that the opening and closing part 24 for mounting cannot be closed.

Figure 20:
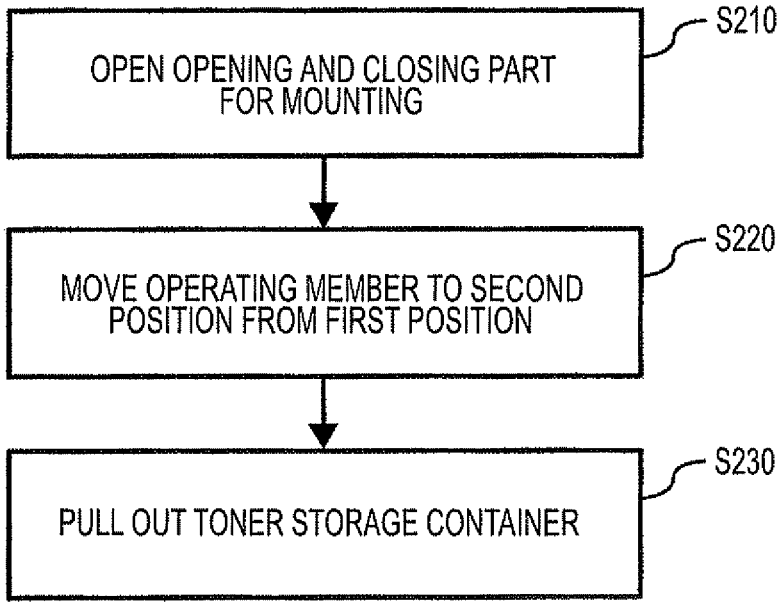
FIG. 20 is a view illustrating the process of detaching the storage container according to the exemplary embodiment of the invention from the image forming apparatus body.

The process of detaching the storage container 306 from the inside of the image forming apparatus body 20 is illustrated in FIG. 20. As shown in FIG. 20, in a first step S210, the opening and closing part 24 for mounting is opened, and the top of the mounting device 30 is opened.

In the next step S220, the operating member 380 is moved to the second position from the first position, thereby bringing the discharge hole 312 into a closed state. For this reason, when the storage container 300 is detached from the image forming apparatus body 20, remaining toner is not discharged from the discharge hole 312.

In the next step S230, the storage container 300 is pulled out from the image forming apparatus body 20. When the storage container 300 is pulled out from the image forming apparatus body 20 without the operating member 380 moved to the second position from the first position, the guiding projection 394 interferes with the portion of the left side plate 42 which forms the circular-arc portion 50, so that the storage container 300 cannot be detached from the image forming apparatus body 20.

In the exemplary embodiment described above, a combination of two members including the opening and closing member 352 and the sealing member 354 is shown as an example of the opening and closing part 350. However, the opening and closing member 350 may be a single part, or may be a combination of three or more parts.

Additionally, in the exemplary embodiment described above, movement to the first position, the second position, and the third position is described as an example of the operation of the operating member 380. However, the operating member 380 may be adapted so as to be able to move to other single or plural positions along with the first position, the second position, and the third position. For example, a plurality of parts of the operating member 380 composed of a plurality of parts may be assembled at a fourth position, or the operating member 380 may be attached to the container body 306 at a fourth position so that the operating member 380 can be moved to the fourth position.

Additionally, in the exemplary embodiment described above, the example has been described in which the lid member 340 is used as the sealing part attached to the container body 306 so as to seal the filling hole 314, the lid member 340 seals the filling hole 314 so as to fit into the filling hole 314 of the lid member 340, and the cover member 342 is mounted to the container body 306 so as to cover the lid member 340. However, the cover member 342 may not be provided. Additionally, instead of fitting the lid member 340 into the filling hole 314, for example, the filling hole 314 may be sealed, for example, by using a tape having an adhesive part as a sealing part, and attaching the tape to the filling hole 314 so as to cover the filling hole. When the filling hole 314 is sealed using the tape in this way, the cover member 342 may be mounted to the container body 306 so as to cover the tape, or the cover member 342 may not be mounted to the container body 306.

Additionally, for example, an identifying member which identifies the storage container 300 may be attached to the lid member 340 attached to the container body 306 so as to seal the filling hole 314, the above-described tape, or the cover member 342 attached so as to cover the lid member 340 or the tape. As an example of the identifying member, for example, an identifying label attached to the lid member 340, etc. can be mentioned. For example, a model number of the storage container 300, a model number of the image forming apparatus 10 which can mount the storage container 300, the product name of the storage container 300, the product name of the image forming apparatus 10 which can mount the storage container 300, the color (whether filled toner is yellow, magenta, cyan, or black) of a toner filled into the container body 306, etc. are indicated on the identifying member.

Additionally, for example, a descriptive member which describes the usage of the storage container 300 may be attached to the lid member 340 attached to the container body 306 so as to seal the filling hole 314, the above-described tape, or the cover member 342 attached so as to cover the lid member 340 or the tape. As an example of the descriptive member, for example, a descriptive label attached to the lid member 340, etc. can be mentioned. For example, a method of mounting the storage container 300 to the inside of the image forming apparatus body 20, and detaching the storage container 300 from the inside of the image forming apparatus body 20 is indicated on the descriptive member. More specifically, for example, a method of operating the operating member 380 which mounts the storage container 300 to the inside of the image forming apparatus body 20, or a method of operating the operating member 380 when the storage container 300 is detached from the inside of the image forming apparatus body 20 is indicated. Such a descriptive member may be one member so as to be also used as the aforementioned identifying member, or the descriptive member and the identifying member may be separate members.

Moreover, instead of separately attaching the identifying member or the descriptive member, an identifying label or a descriptive label itself may be used as the above-described tape.

INDUSTRIAL APPLICABILITY

Additionally, in the exemplary embodiment described above, a form in which a container is filled with toner made of powder serving as an example of an image forming agent has been described. However, the invention can also be applied to a case where a container is filled with, for example, ink or the like made of liquid.

As described above, the invention can be applied to an image forming agent storage container, an image forming apparatus, a method of mounting the image forming agent storage container, a method of detaching the image forming agent storage container, a method of filling an image forming agent, and a method of refilling the image forming agent.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming agent storage container comprising:

a container body that is attached to and detached from an inside of an image forming apparatus body, and that is formed with a discharge hole used for discharging an image forming agent and a filling hole used for filling the image forming agent, wherein the discharge hole is formed on one side of the container body on a line formed by directions in which the container body is attached to and detached from the inside of the image forming apparatus body, and the filling hole is formed on the other side of the container body on the line formed by the directions in which the container body is attached to and detached from the inside of the image forming apparatus body;

a sealing part that is attached to the container body to seal the filling hole on the line formed by the directions in which the container body is attached to and detached from the inside of the image forming apparatus body;

an opening and closing part that opens and closes the discharge hole while moving relative to the container body; and an operating part (i) that has a facing portion facing the filling hole, (ii) that is connected to the opening closing part, (iii) that is supported to rotate relative to the container body, and (iv) that is used to move the opening and closing part relative to the container body, wherein the operating part moves between a first position where the discharge hole is brought into an opened state, and where the facing portion is arranged at a position which overlaps the container body in a direction parallel to the line formed by the directions in which the container body is attached to and detached from the inside of the image forming apparatus body, a second position where the discharge hole is brought into a closed state, and where the facing portion is arranged at a position which overlaps the container body in the direction parallel to the line formed by the directions in which the container body is attached to and detached from the inside of the image forming apparatus body, and a third position where the discharge hole is brought into the closed state, and where the facing portion is arranged at a position which does not overlap the container body in the direction parallel to the line formed by the directions in which the container body is attached to and detached from the inside of the image forming apparatus body.

2. The image forming agent storage container according to claim 1, wherein the container body further comprises:

an opening prohibiting part that interferes with the opening and closing part and prohibits the opening and closing part from moving and opening the discharge hole in a state where the storage container is not mounted to the inside of the image forming apparatus body.

3. The image forming agent storage container according to claim 1, further comprising:

a movement prohibiting part that prohibits the operating part from moving to the first position in a state where the storage container is not mounted to the inside of the image forming apparatus body.

4. The image forming agent storage container according to claim 1, further comprising:

a fixing part that fixes the operating part to the third position.

5. The image forming agent storage container according to claim 1, further comprising:

an interference part that interferes with the image forming apparatus body when the storage container is mounted to the inside of the image forming apparatus body in a state where the operating part is arranged at the third position.

6. The image forming agent storage container according to claim 1, wherein the second position and the third position of the operating part are adjacent to each other in a movement direction of the operating part.

7. The image forming agent storage container according to claim 1, wherein the discharge hole is formed in an upward face of the container body in a direction of gravitational force.

8. The image forming agent storage container according to claim 1, further comprising:

a stirring part that is provided in the container body, and that is used to stir the image forming agent stored within the storage container, wherein the stirring part is capable of being arranged so that a longitudinal direction thereof coincides with a direction in which the image forming agent is filled.

9. The image forming agent storage container according to claim 1, further comprising:

an identification part that identifies a kind of the image forming agent being stored, wherein the identification part is arranged at a visible position in a state where at least the operating part is arranged at the second position.

10. An image forming apparatus comprising:

an image forming apparatus body;

an image forming agent storage container that is attached to and detached from an inside of the image forming apparatus body; and an image forming part that forms an image using an image forming agent stored within the image forming agent storage container, wherein the image forming agent storage container comprises:

a container body that is attached to and detached from the inside of an image forming apparatus body, and that is formed with a discharge hole used for discharging an image forming agent and a filling hole used for filling the image forming agent, wherein the discharge hole is formed on one side of the container body on a line formed by directions in which the container body is attached to and detached from the inside of the image forming apparatus body, and the filling hole is formed on the other side of the container body on the line formed by the directions in which the container body is attached to and detached from the inside of the image forming apparatus body;

a sealing part that is attached to the container body to seal the filling hole on the line formed by the directions in which the container body is attached to and detached from the inside of the image forming apparatus body;

an opening and closing part that opens and closes the discharge hole while moving relative to the container body; and an operating part (i) that has a facing portion facing the filling hole, (ii) that is connected to the opening closing part, (iii) that is supported to rotate relative to the container body, and (iv) that is used to move the opening and closing part relative to the container body, wherein the operating part moves between a first position where the discharge hole is brought into an opened state, and where the facing portion is arranged at a position which overlaps the container body in a direction parallel to the line formed by the directions in which the container body is attached to and detached from the inside of the image forming apparatus body, a second position where the discharge hole is brought into a closed state, and where the facing portion is arranged at a position which overlaps the container body in the direction parallel to the line formed by the directions in which the container body is attached to and detached from the inside of the image forming apparatus body, and a third position where the discharge hole is brought into the closed state, and where the facing portion is arranged at a position which does not overlap the container body in the direction parallel to the line formed by the directions in which the container body is attached to and detached from the inside of the image forming apparatus body.

11. The image forming apparatus according to claim 10, further comprising:

a detachment prohibiting part that prohibits the image forming agent storage container from being detached from the inside of the image forming apparatus body in a state where the operation part is arranged at the first position.

12. A method of filling an image forming agent into an image forming agent storage container, the image forming agent storage container including:

a container body that is attached to and detached from an inside of an image forming apparatus body, and that is formed with a discharge hole used for discharging an image forming agent and a filling hole used for filling the image forming agent, wherein the discharge hole is formed on one side of the container body on a line formed by directions in which the container body is attached to and detached from the inside of the image forming apparatus body, and the filling hole is formed on the other side of the container body on the line formed by the directions in which the container body is attached to and detached from the inside of the image forming apparatus body;

a sealing part that is attached to the container body to seal the filling hole on the line formed by the directions in which the container body is attached to and detached from the inside of the image forming apparatus body;

an opening and closing part that opens and closes the discharge hole while moving relative to the container body; and an operating part (i) that has a facing portion facing the filling hole, (ii) that is connected to the opening closing part, (iii) that is supported to rotate relative to the container body, and (iv) that is used to move the opening and closing part relative to the container body, wherein the operating part moves between a first position where the discharge hole is brought into an opened state, and where the facing portion is arranged at a position which overlaps the container body in a direction parallel to the line formed by the directions in which the container body is attached to and detached from the inside of the image forming apparatus body, a second position where the discharge hole is brought into a closed state, and where the facing portion is arranged at a position which overlaps the container body in the direction parallel to the line formed by the directions in which the container body is attached to and detached from the inside of the image forming apparatus body, and a third position where the discharge hole is brought into the closed state, and where the facing portion is arranged at a position which does not overlap the container body in the direction parallel to the line formed by the directions in which the container body is attached to and detached from the inside of the image forming apparatus body, the method comprising:

filling the image forming agent via the filling hole into the container body of the image forming agent storage container in a state where the operating part is arranged at the third position;

attaching the sealing part to the container body after the image forming agent is filled; and moving the operating part to the second position from the third position after the sealing part is attached to the container body.

13. A method of refilling an image forming agent into an image forming agent storage container, the image forming agent storage container including:

a container body that is attached to and detached from an inside of an image forming apparatus body, and that is formed with a discharge hole used for discharging an image forming agent and a filling hole used for filling the image forming agent, wherein the discharge hole is formed on one side of the container body on a line formed by directions in which the container body is attached to and detached from the inside of the image forming apparatus body, and the filling hole is formed on the other side of the container body on the line formed by the directions in which the container body is attached to and detached from the inside of the image forming apparatus body;

a sealing part that is attached to the container body to seal the filling hole on the line formed by the directions in which the container body is attached to and detached from the inside of the image forming apparatus body;

an opening and closing part that opens and closes the discharge hole while moving relative to the container body; and an operating part (i) that has a facing portion facing the filling hole, (ii) that is connected to the opening closing part, (iii) that is supported to rotate relative to the container body, and (iv) that is used to move the opening and closing part relative to the container body, wherein the operating part moves between a first position where the discharge hole is brought into an opened state, and where the facing portion is arranged at a position which overlaps the container body in a direction parallel to the line formed by the directions in which the container body is attached to and detached from the inside of the image forming apparatus body, a second position where the discharge hole is brought into a closed state, and where the facing portion is arranged at a position which overlaps the container body in the direction parallel to the line formed by the directions in which the container body is attached to and detached from the inside of the image forming apparatus body, and a third position where the discharge hole is brought into the closed state, and where the facing portion is arranged at a position which does not overlap the container body in the direction parallel to the line formed by the directions in which the container body is attached to and detached from the inside of the image forming apparatus body, the method comprising:

moving the operating part of the image forming agent storage container to the third position;

detaching the sealing part from the container body after the operating part is moved to the third position;

filling the image forming agent into the container body via the filling hole in a state where the sealing part is detached; and attaching the sealing part or another sealing part to the container body into which the image forming agent has been filled so as to seal the filling hole.

* * * * *